US007242873B2

(12) United States Patent
Saisu et al.

(10) Patent No.: US 7,242,873 B2
(45) Date of Patent: Jul. 10, 2007

(54) IMAGE FORMING APPARATUS MOUNTED WITH REPLACEABLE UNIT, IMAGE FORMING SYSTEM, AND METHOD OF CONTROLLING IMAGE FORMING APPARATUS

(75) Inventors: Mikio Saisu, Saitama (JP); Yasushi Sakata, Saitama (JP); Kiyoshi Nagamine, Saitama (JP); Haruhiko Okabe, Saitama (JP); Takeshi Yokoe, Saitama (JP); Tsuneo Toda, Saitama (JP); Akinori Ono, Saitama (JP); Hiroh Soga, Saitama (JP); Kiyoshi Kimura, Saitama (JP)

(73) Assignee: Fuji Xerox Co. Ltd., Tokyo (JP)

( * ) Notice: Subject to any disclaimer, the term of this patent is extended or adjusted under 35 U.S.C. 154(b) by 327 days.

(21) Appl. No.: 11/084,790

(22) Filed: Mar. 21, 2005

(65) Prior Publication Data

US 2005/0254840 A1 Nov. 17, 2005

(30) Foreign Application Priority Data

May 17, 2004 (JP) ..... 2004-146141
May 17, 2004 (JP) ..... 2004-146143

(51) Int. Cl.
*G03G 15/00* (2006.01)

(52) U.S. Cl. ..... 399/12; 399/13; 399/24

(58) Field of Classification Search ..... 399/8, 399/9, 12, 13, 24; 347/19, 86
See application file for complete search history.

(56) References Cited

U.S. PATENT DOCUMENTS 7,139,494 B2 * 11/2006 Ono et al. ..... 399/12
7,177,553 B2 * 2/2007 Ono ..... 399/12

FOREIGN PATENT DOCUMENTS

| | | |
|---|---|---|
| JP | A 06-149051 | 5/1994 |
| JP | B2 2602341 | 1/1997 |
| JP | A 10-133528 | 5/1998 |
| JP | A 2001-100598 | 4/2001 |
| JP | B2 3476704 | 9/2003 |

* cited by examiner

*Primary Examiner*—Hoan Tran
(74) *Attorney, Agent, or Firm*—Oliff & Berridge, PLC

(57) ABSTRACT

An image forming apparatus has at least one replaceable unit replaceably mounted to an image forming apparatus main body. The image forming apparatus outputs a message purporting that a reservation of an operation mode can be received, at the timing that a replacement timing of the replaceable unit which is currently mounted is close in time. If so, prior to the replacement of the replaceable unit which is current mounted, a reservation of an operation mode for a replaceable unit which is to be mounted next time may be received. Further, if the replacement of the replaceable unit is detected, the image forming apparatus starts the control according to the reserved operation mode.

21 Claims, 31 Drawing Sheets

IMAGE FORMING APPARATUS MOUNTED WITH REPLACEABLE UNIT, IMAGE FORMING SYSTEM, AND METHOD OF CONTROLLING IMAGE FORMING APPARATUS

BACKGROUND OF THE INVENTION

1. Field of the Invention

The present invention relates to an image forming apparatus mounted with replaceable units, an image forming system, and a method of controlling the image forming apparatus, and more specifically, to an image forming apparatus in which the replaceable units are replaceably mounted in an image forming apparatus main body.

2. Background Art

An image forming apparatus which allows a user to easily replace a unit including consumables and the like is known.

Meanwhile, if a replaceable unit replaced by a user is not a genuine article for an image forming apparatus, there are problems in that the performance of the image forming apparatus cannot be sufficiently exhibited, like deterioration of the image quality, the operation of the apparatus cannot be guaranteed, or the apparatus can get out of order. This is because the image forming apparatus controls processes for forming an image in consideration of characteristics of a toner, characteristics of an image carrier, an electrification voltage, cleaning characteristics, fixing characteristics and the like.

Therefore, in order to maintain the image quality of an image forming apparatus, and to prevent occurrence of the above problems, JP-A-10-133528 discloses a method which comprises providing a genuine replaceable part with a data carrier for holding consumption data on consumables, and discriminating whether the genuine replaceable unit has been supplied with the consumables by comparing a consumption detected by a consumption detecting unit provided in an image forming apparatus main body with the consumption data held by the data carrier.

Further, JP-A-6-149051 discloses a method which comprises providing a toner cartridge with a storage unit for storing predetermined coded data, and inhibiting copying when the predetermined coded data stored in the storage unit has not yet been read from the copying machine main body side.

Further, JP-A-2001-100598 discloses a method which comprises performing warning display and printing inhibition when empty information to be written in a cartridge at the time of detection of run-out of a toner is read from a cartridge refilled with a toner.

Further, Japanese Patent No. 2602341 discloses a method which comprises making the count of the images formed and storing it in a memory of a cartridge, and, if a preset final count representing the number of images capable of being formed by a cartridge is equal to the count of images which are actually formed, disabling the cartridge from being used afterwards.

Moreover, Japanese Patent No. 3476704 discloses a method which comprises setting an image forming condition whose level is lowered than that of an appropriate image forming condition, thereby allowing a user to easily find the fact that a mounted toner refilling container is inappropriate, when it is determined that the toner refilling container is inappropriate through duplex communication between a communication unit of the toner refilling container side and a communication unit of an apparatus main body side, and a selective input unit selects the fact that the user continues to refill a toner while inappropriateness of the container is ignored.

SUMMARY OF THE INVENTION

An object of the present invention is to provide an image forming apparatus, an image forming system, and a method of controlling an image forming apparatus, which can use a replaceable unit other than a genuine article by a user's intention, even when the replaceable unit other than a genuine article is mounted. Further, a second object of the present invention is to provide an image forming apparatus, an image forming system, and a method of controlling an image forming apparatus, which can perform switching of an operation mode smoothly following a replacement of a replaceable unit. Further, a third object of the present invention is to provide an image forming apparatus and an image forming system, which enables a user to appropriately cope with situations, which may occur if a replaceable unit has been replaced.

According to a first aspect of the invention, there is provided an image forming apparatus including an image forming apparatus main body, at least one replaceable unit replaceably mounted to the image forming apparatus main body, an input unit for selecting any one of an operation mode corresponding to the replaceable unit which is a genuine article and operation modes different from the operation mode, a control unit for performing controls according to an operation mode selected by the input unit, and a reservation receiving unit for, when an operation mode with respect to a replaceable unit to be mounted next to the replaceable unit is selected by the input unit before the replacement of the replaceable unit which is being mounted, receiving the selected operation mode as a reservation, in which, when the reservation of an operation mode is received by the reservation receiving unit, the control unit applies the operation mode according to the received reservation.

Preferably, the image forming apparatus further includes a lifetime detecting unit for detecting a lapse of a usable time of the replaceable unit which is being mounted, in which, when the lapse of the usable time of the replaceable unit is detected by the lifetime detecting unit, the control unit starts controls according to the reserved operation mode.

Preferably, the image forming apparatus further includes a replacement detecting unit for detecting a replacement of the replaceable unit, in which, when the replacement of the replaceable unit is detected by the replacement detecting unit, the control unit starts controls according to the reserved operation mode.

Preferably, the image forming apparatus further includes a message output unit for outputting a reservation start message which urges the reservation of the operation mode, at a timing according to a consumption of the replaceable unit, in which, between the timing at which the reservation start message is output and a timing at which the replaceable unit is replaced, when an operation mode is selected by the input unit, the reservation receiving unit receives the selected operation mode as the reservation.

Preferably, the image forming apparatus further includes a discriminating unit that discriminates whether or not the replaceable unit is the genuine article, in which the control unit decides an operation mode to be applied according to a combination of a discrimination result of the discriminating unit and the reserved operation mode by the reservation receiving unit.

Preferably, when the operation mode corresponding to the discrimination result of the discriminating unit and the reserved operation mode by the reservation receiving unit discord with each other, the control unit starts controls according to the operation mode corresponding to the discrimination result or the reserved operation mode.

According to a second aspect of the invention, there is provided a image forming apparatus including an image forming apparatus main body, at least one replaceable unit replaceably mounted to the image forming apparatus main body, a message output unit for outputting a reservation start message which urges a reservation of an operation mode, at a timing according to a consumption of the replaceable unit, a reservation receiving unit for receiving the reservation of the operation mode, and a control unit for performing controls according to the reservation of the operation mode received by the reservation receiving unit.

According to a third aspect of the invention, there is provided a image forming system including an image forming apparatus, and a host apparatus connected to the image forming apparatus. Further, the host apparatus includes an input unit for selecting any one of an operation mode corresponding to a replaceable unit which is a genuine article and other operation modes different from the operation mode. In addition, the image forming apparatus includes an image forming apparatus main body, at least one replaceable unit replaceably mounted to the image forming apparatus main body, a control unit for performing controls according to an operation mode selected by the input unit, and a reservation receiving unit for, when an operation mode with respect to a replaceable unit to be mounted next to the replaceable unit which is being mounted is selected by the input unit before the replacement of the replaceable unit which is being mounted, receiving the selected operation mode as a reservation. Here, when the reservation of an operation mode with respect to any one replaceable unit is received by the reservation receiving unit, the control unit performs controls according to the reserved operation mode.

According to a fourth aspect of the invention, there is provided a method of controlling an image forming apparatus in which at least one replaceable unit is replaceably mounted to an image forming apparatus main body. The method includes a step of receiving a reservation of an operation mode with respect to a replaceable unit to be mounted next to the replaceable unit which is being mounted before the replacement of the replaceable unit which is being mounted, and a step of starting controls according to the reserved operation mode on an assumption that the replaceable unit which was being mounted has been replaced.

In addition, the operation mode mentioned herein means aspects of control of an image forming apparatus, and includes not only programs and control parameters for forming an image, but also input and output conditions, and further includes aspects of display onto a display device, which are not directly related to the image formation.

According to a fifth aspect of the invention, there is provided an image forming apparatus including: an image forming apparatus main body; at least one replaceable unit replaceably mounted in the image forming apparatus main body; a discriminating unit that discriminates whether or not the replaceable unit is genuine; a switching unit that switches a first operation mode corresponding to the replaceable unit which is genuine to a second operation mode corresponding to the replaceable unit which is not genuine, and a control unit that performs control in an operation mode switched by the switching unit. Accordingly, if a replaceable unit as a genuine article has been replaced with any one other the genuine article, the switching unit switches a current operation mode to the second mode corresponding to any one other than a genuine article. Thus, image forming can be performed under the control by the second operation mode.

In addition, the operation mode mentioned herein means aspects of control of an image forming apparatus, and includes not only programs and control parameters for forming an image, but also input and output conditions, and further includes aspects of display onto a display device, which are not directly related to the image formation.

Preferably, the image forming apparatus further includes a displaying unit that displays the switching unit. Further, preferably, operation items inappropriate for the first operation mode when the replaceable unit which is not genuine has been mounted are excluded from the second operation mode. If a replaceable unit is not genuine, the consumption of the replaceable unit may be known. In such a case, the consumption of the replaceable unit cannot be displayed, and the corrected amount of a density to be corrected according to the consumption cannot be controlled. Therefore, such operation items are excluded. However, operation items which limit printing are not excluded, even if a replaceable unit is not genuine.

Further, preferably, the image forming apparatus further includes an indicating unit that indicates an image forming operation, and the control unit cancels the indication of the indicating unit, if the first operation mode is set, and the discriminating unit discriminates that the replaceable unit is not genuine. If a current operation mode is switched to the second operation mode, the indication of the indicating unit is effective. However, if the setting to the first operation mode is maintained, the operation cannot be guaranteed. Therefore, the indication of the indicating unit is cancelled so as to disable printing. Moreover, preferably, the switching unit automatically switches an operation mode according to discrimination results of the discriminating unit.

According to a sixth aspect of the invention, there is provided an image forming apparatus including: an image forming apparatus main body; at least one replaceable unit replaceably mounted in the image forming apparatus main body; a detecting unit that detects that the replaceable unit has been replaced; a discriminating unit that discriminates, if the detecting unit detects that the replaceable unit has been replaced, whether or not the replaced replaceable unit is genuine; a switching unit that switches a first operation mode corresponding to the replaceable unit which is genuine to a second operation mode corresponding to the replaceable unit which is not genuine; and a control unit that performs control in an operation mode switched by the switching unit. Accordingly, if a replaceable unit as other than the genuine article is replaced with any one genuine article, the switching unit switches a current operation mode to the first operation mode corresponding to the genuine article, which makes it possible to perform appropriate control.

According to a seventh aspect of the invention, there is provided an image forming apparatus including: an image forming apparatus main body; at least one replaceable unit replaceably mounted in the image forming apparatus main body; a discriminating unit that discriminates whether or not the replaceable unit is genuine; a switching unit that switches a second operation mode corresponding to the replaceable unit which is not genuine to a first operation mode corresponding to the replaceable unit which is genuine; and a control unit that performs control in an operation mode switched by the switching unit.

According to a eighth aspect of the invention, there is provided an image forming apparatus including: an image forming apparatus main body; at least one replaceable unit replaceably mounted in the image forming apparatus main body; a detecting unit that detects that the replaceable unit has been replaced; a discriminating unit that discriminates, if the detecting unit detects that the replaceable unit has been replaced, whether or not the replaced replaceable unit is genuine; a switching unit that switches a first operation mode corresponding to the replaceable unit which is genuine to a second operation mode corresponding to the replaceable unit which is not genuine; and a control unit that performs control in an operation mode switched by the switching unit.

According to a ninth aspect of the invention, there is provided image forming system including: an image forming apparatus including an image forming apparatus main body; at least one replaceable unit replaceably mounted in the image forming apparatus main body; a discriminating unit that discriminates whether or not the replaceable unit is genuine; and a control unit that performs control in a predetermined operation mode, and a host apparatus connected to the image forming apparatus, wherein the host apparatus includes a switching unit that switches a first operation mode corresponding to the replaceable unit which is genuine to a second operation mode corresponding to the replaceable unit which is not genuine. Accordingly, since the switching unit is provided in the host apparatus, the first operation mode can be switched to the second operation mode through the host apparatus.

According to a tenth aspect of the invention, there is provided an image forming system including: an image forming apparatus including: an image forming apparatus main body; at least one replaceable unit replaceably mounted in the image forming apparatus main body; a detecting unit that detects that the replaceable unit has been replaced; a discriminating unit that discriminates, if the detecting unit detects that the replaceable unit has been replaced, whether or not the replaced replaceable unit is genuine; and a control unit that performs control in a predetermined operation mode, and a host apparatus connected to the image forming apparatus, wherein the host apparatus includes a switching unit that switches a first operation mode corresponding to the replaceable unit which is genuine to a second operation mode corresponding to the replaceable unit which is not genuine.

According to an eleventh aspect of the invention, there is provided an image forming system including: an image forming apparatus including: an image forming apparatus main body; at least one replaceable unit replaceably mounted in the image forming apparatus main body; a discriminating unit that discriminates whether or not the replaceable unit is genuine; and a control unit that performs control in a predetermined operation mode, and a host apparatus connected to the image forming apparatus, wherein the host apparatus includes a switching unit that switches a second operation mode corresponding to the replaceable unit which is not genuine to a first operation mode corresponding to the replaceable unit which is genuine.

According to a twelfth aspect of the invention, there is provided an image forming system including: an image forming apparatus including: an image forming apparatus main body; at least one replaceable unit replaceably mounted in the image forming apparatus main body; a detecting unit that detects that the replaceable unit has been replaced, a discriminating unit that discriminates, if the detecting unit detects that the replaceable unit has been replaced, whether or not the replaced replaceable unit is genuine; a control unit that performs control in a predetermined operation mode, and a host apparatus connected to the image forming apparatus, wherein the host apparatus includes a switching unit that switches a second operation mode corresponding to the replaceable unit which is not genuine to a first operation mode corresponding to the replaceable unit which is genuine.

According to the present invention, a replaceable unit other than a genuine article can be used by the user's intention, even when the replaceable unit other than a genuine article is mounted. Further, the switching of the operation mode following the replacement of the replaceable unit can be smoothly performed. Further, according to the present invention, a user can appropriately cope with situations, which may occur if a replaceable unit has been replaced.

According to the present invention, a user can use a replaceable unit other than a genuine article, by the user's intention, even when the replaceable unit other than a genuine article is mounted. Further, the switching of the operation mode following the replacement of the replaceable unit can be smoothly performed. Further, according to the present invention, a user can appropriately cope with situations, which may occur if a replaceable unit has been replaced.

BRIEF DESCRIPTION OF THE DRAWINGS

These and other objects and advantages of this invention will become more fully apparent from the following detailed description taken with the accompanying drawings in which:

FIGS. 17A and 17B are graphs showing results corrected by the setting shown in FIG. 16, in which FIG. 17A shows a corrected toner density and FIG. 17B shows a corrected image density;

FIGS. 23A and 23B are diagrams exemplarily showing a screen displayed on a UI device, in which FIG. 23A shows a screen for an input when a user starts to select an operation mode, and FIG. 23B shows a screen for an input when a user starts to reserve an operation mode;

FIGS. 25A and 25B are diagrams exemplarily showing a screen displayed on a UI device, in which FIG. 25A shows an operation mode selection screen when a genuine toner cartridge is mounted, and FIG. 25B shows an operation mode selection screen when a non-genuine toner cartridge is mounted;

DETAILED DESCRIPTION OF THE PREFERRED EMBODIMENTS

First Embodiment

Hereinafter, embodiments of the present invention will be described with reference to the accompanying drawings.

Figure 1:
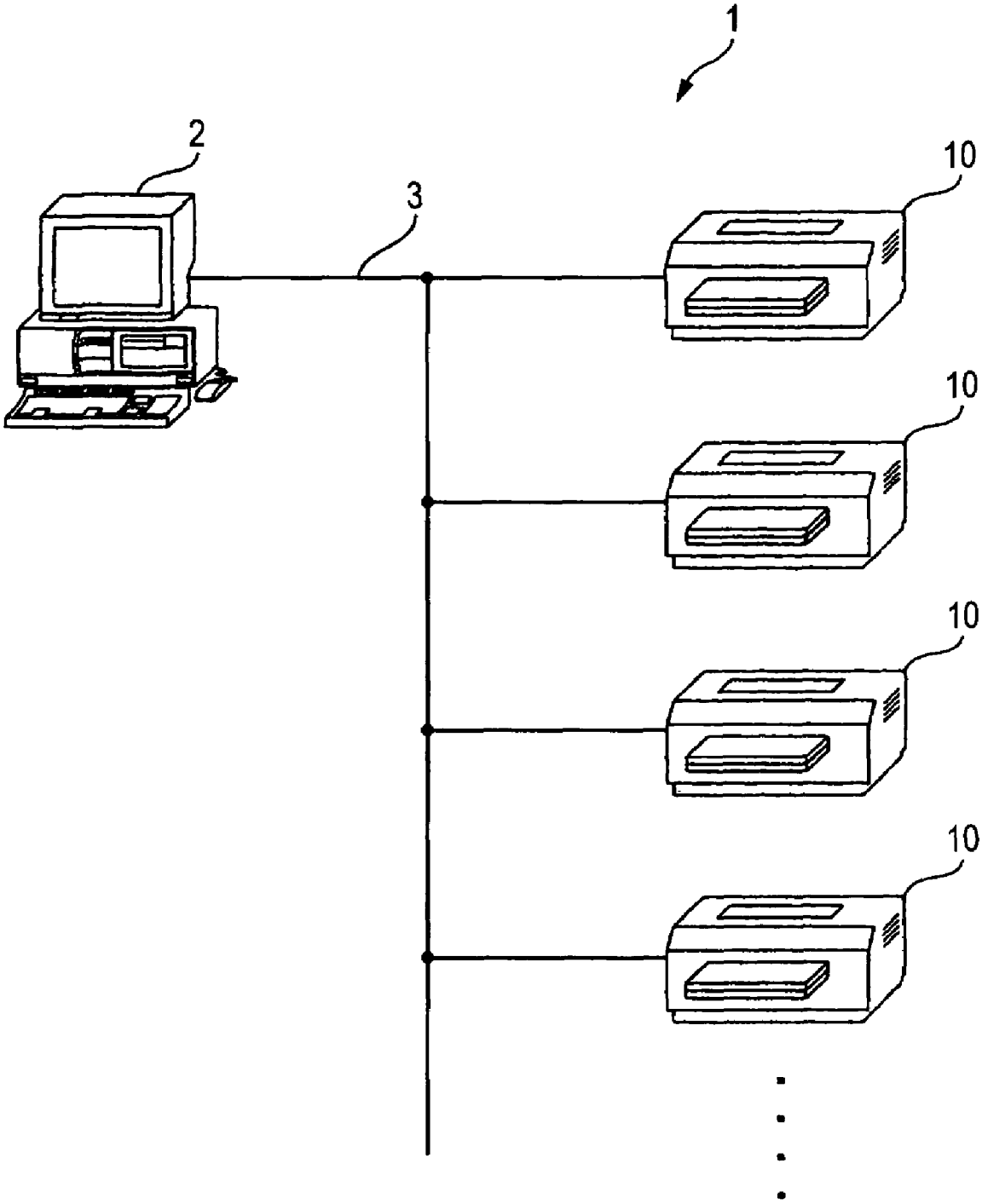
FIG. 1 is a schematic diagram of an image forming system according to an embodiment of the present invention.

FIG. 1 illustrates an image forming system 1 according to an embodiment of the present invention. The image forming system 1 is constructed by connecting a host apparatus 2, such as a personal computer (PC) to, for example, a plurality of image forming apparatuses 10 via a network 3. The host apparatus 2 may be a terminal having a control device, such as a micro controller unit (MCU), an input-output device, such as a touch panel, and a communication device for transmitting or receiving signals via the network 3, except the PC. The network 3 may be constructed by wire or wireless. Further, a plurality of the host apparatuses 2 may be connected to the network 3.

As such, the image forming system 1 is constructed such that the host apparatus 2 can control the image forming apparatuses 10 via the network 3.

Figure 2:
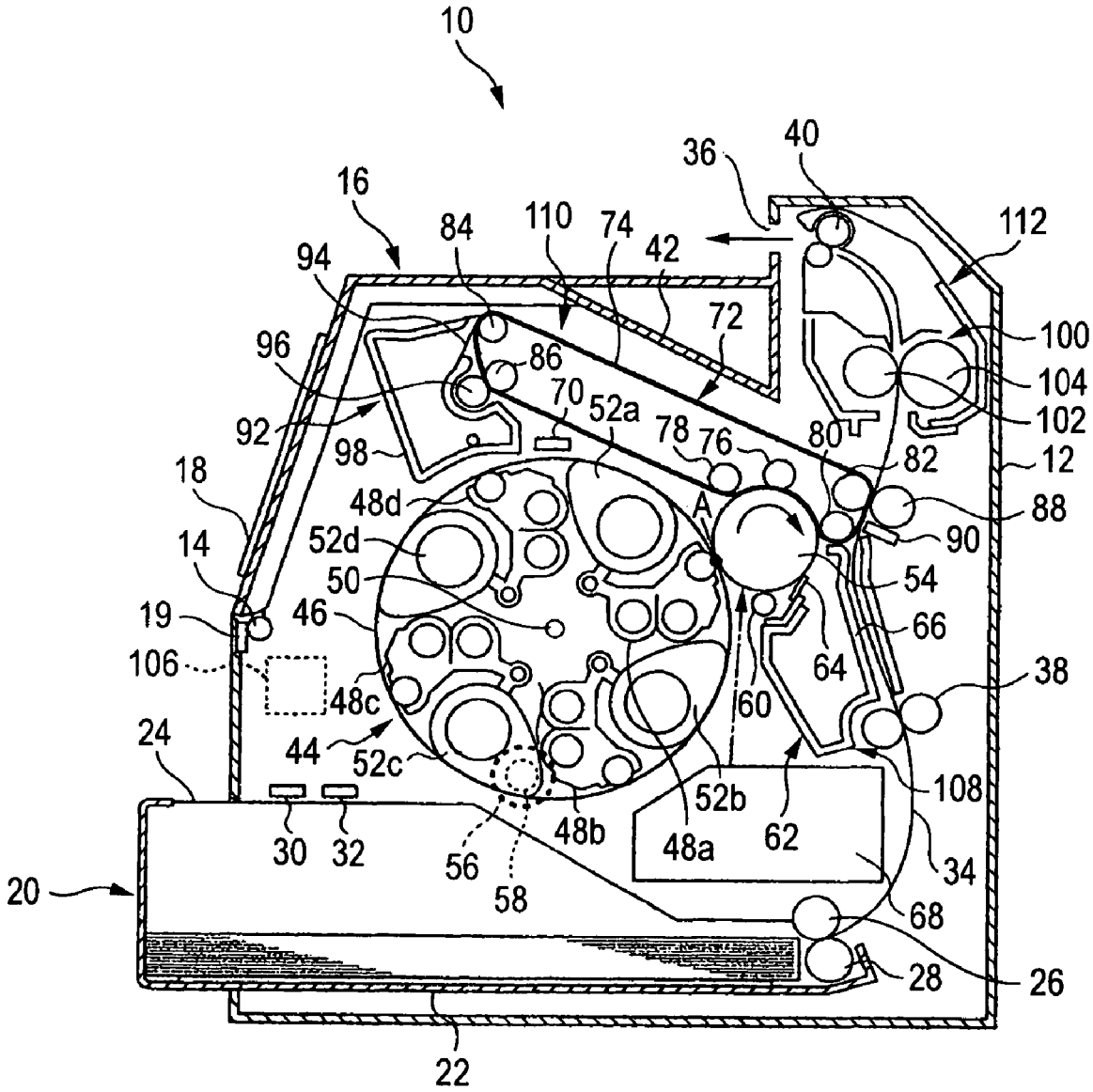
FIG. 2 is a side view schematically showing an image forming apparatus according to the embodiment of the present invention.

FIG. 2 schematically illustrates an image forming apparatus 10. The image forming apparatus 10 has an image forming apparatus main body 12, and an opening and closing cover 16 is provided at an upper portion of the image forming apparatus main body 12 to rotate about a fulcrum 14. A user interface device (UI device) 18, such as a touch panel, is provided on the front side (the left side in FIG. 2) of the opening and closing cover 16. The UI device 18 displays control information or instruction information of the image forming apparatus 10, and the instruction information from a user is input to the UI device 18. That is, a user can operate the image forming apparatus 10 via the UI device 18. Meanwhile, the UI device 18 may be a device for performing only the input of signals, such as a switch, or may be a device for receiving only the output of signals, such as display. Otherwise, the UI device 18 may be a combined device for performing both the input and output of signals.

Further, an opening and closing detecting sensor 19 is provided in the vicinity of the fulcrum 14 to detect the opening or closing of the opening and closing cover 16 by contact or separation according to opening or closing of the opening and closing cover 16.

For example, one-stage sheet feeding unit 20 is provided at a lower portion of the image forming apparatus main body 12. The sheet feeding unit 20 has a sheet feeding unit main body 22 and a sheet feeding cassette 24 for receiving sheets. A feeding roller 26 for feeding sheets from the sheet feeding cassette 24 and a retard roller 28 for separating the fed sheets one by one are arranged at the upper portion of the vicinity of a rear end of the sheet feeding cassette 24. Further, a temperature sensor 30 for detecting the temperature in the image forming apparatus main body 12 and a humidity sensor 32 for detecting the humidity in the image forming apparatus main body 12 are provided above the sheet feeding cassette 24.

A conveying path 34 is a sheet conveying path from the feeding roller 26 to a discharge port 36, and the conveying path 34 is formed substantially vertically from the sheet feeding unit 20 to a fixing device 100, which will be described later, in the vicinity of the rear side (the right side in FIG. 2) of the image forming apparatus main body 12. A secondary transfer roller 88 and a secondary transfer backup roller 82, which will be described later, are arranged upstream of the fixing device 100 in the conveying path 34, and a resist roller 38 is arranged downstream of the secondary transfer roller 88 and the secondary transfer backup roller 82. Further, a discharge roller 40 is arranged in the vicinity of the discharge port 36 in the conveying path 34.

Accordingly, the sheets fed by the feeding roller 26 from the sheet feeding cassette 24 of the sheet feeding unit 20 are separated by the retard roller 28, and only the topmost sheet is guided to the conveying path 34. Then, the conveyance of the guided sheet is temporally stopped by the resist roller 38, and the sheet passes between the secondary transfer roller 88 and the secondary transfer backup roller 82, which will be described later, at a predetermined timing, so that a toner image is transferred onto the sheet. Subsequently, the transferred toner image is fixed by the fixing device 100, and the sheet is then discharged by the discharge roller 40 from the discharge port 36 to a discharge section 42 provided on the upper side of the opening and closing cover 16. The discharge section 42 slopes gradually downward from the front side (the left side in FIG. 2) thereof toward the discharge port.

A developer container unit 44, such as a rotary developing device, is arranged, for example, substantially at the center of the image forming apparatus main body 12. The developer container unit 44 has a developer container unit main body 46, and the developer container unit main body 46 is mounted with four developer containers 48*a* to 48*d* for forming a toner image. These developer containers 48*a* to 48*d* rotate left (in the counterclockwise direction in FIG. 2) about a rotating shaft 50 with the developer container unit main body 46. The developer containers 48*a* to 48*d* are mounted with tubular toner cartridges 52*a* to 52*d* for containing toners of yellow (Y), magenta (M), cyan (C), and black (K), respectively. When the toner cartridges 52*a* to 52*d* are mounted in the developer container unit main body 46 through the developer containers 48*a* to 48*d*, the toner cartridges 52*a* to 52*d* are mounted such that their outer surfaces almost coincide with the outer circumference of the developer container unit main body 46.

An image carrier 54 made of, for example, a photoreceptor is arranged so as to abut on the developer container unit 44 from the rear side (the right side in FIG. 2) of the image forming apparatus 10. Specifically, four colors of Y, M, C, and K are prepared in the developer container unit 44 to perform full color development, and the developer containers 48*a* to 48*d* are rotated and positioned at positions to face the image carrier 54 and then develop a latent image on the image carrier 54, using the toners of respective colors of yellow (Y), magenta (M), cyan (C) and black (B), sequentially.

Further, a wireless communication unit 56 is arranged in the vicinity of a position substantially opposite to the image carrier 54 with respect to the rotating shaft 50 of the developer container unit 44. The wireless communication unit 56 has an antenna 58 and communicates with memory chips 170, which will be described later, by wireless.

Further, an electrifying device 60 including, for example, an electrifying roller, is provided below the image carrier 54 for uniformly electrifying the image carrier 54. Further, an image carrier cleaner 62 abuts on the image carrier 54 upstream of the electrifying device 60 in the rotating direction of the image carrier 54. The image carrier cleaner 62 includes a cleaning blade 64 for scraping off a toner remaining on the image carrier 54 after a primary transfer and a waste toner collecting bottle 66 for collecting the toner scraped off by the cleaning blade 64.

Meanwhile, for example, ribs are formed on the rear side (the right side in FIG. 2) of the waste toner collecting bottle 66, and the rear surface of the waste toner collecting bottle 66 is formed into a curved surface such that sheets can be smoothly conveyed. Further, the rear surface of the waste toner collecting bottle 66 constitutes a portion of the conveying path 34.

Further, an exposure device 68 for writing a latent image on the image carrier 54 electrified by the electrifying device 60, using light rays, such as laser beam, is provided below the rear side of the developer container unit 44. Further, an unused state detecting sensor 70, such as a reflective photosensor, for detecting whether the toner cartridges 52*a* to 52*d* mounted in the developer container unit 44 are unused, is provided above the developer container unit 44. An intermediate transfer device 72 is provided above the developer container unit 44 and the unused state detecting sensor 70. The intermediate transfer device 72 primarily transfers the toner image visualized by the developer container unit 44 for each color at a primary transfer position whenever an intermediate transfer body 74 makes one rotation such that the toner image having four colors are superposed on the intermediate transfer body 74, and then collectively transfers the toner image on a sheet at a secondary transfer position which will be described later.

The intermediate transfer device 72 includes an intermediate transfer body 74, such as an intermediate transfer belt, a primary transfer roller 76, a lap-in roller 78, a lap-out roller 80, a secondary backup roller 82, a scraper backup roller 84, and a brush backup roller 86. The intermediate transfer body 74 has, for example, elasticity, and is substantially flatly stretched such that it has long sides and short sides above the developer container unit 44. The upper long side of the intermediate transfer body 74 is stretched such that it is substantially parallel to the discharge section 42 provided on the upper side of the image forming apparatus main body 12. Further, the intermediate transfer body 74 has a primary transfer section (an image carrier lap region) to abut on the image carrier 54 in the shape of a lap between the lap-in roller 78 arranged upstream of the primary transfer roller 76 at the lower long side thereof, and the lap-out roller 80 arranged downstream of the primary transfer roller 76. Also, the intermediate transfer body 74 is wound around the image carrier 54 by a predetermined range to follow the rotation of the imager carrier 54.

Moreover, a planar surface (a short side) is formed at the rear side (the right side in FIG. 2) of the intermediate transfer body 74 by the lap-out roller 80 and the secondary transfer backup roller 82. The planar surface forms a secondary transfer section so as to face the conveying path 34.

As such, a toner image on the image carrier 54 is repeatedly and primarily transferred onto the intermediate transfer body 74 in order of, for example, yellow, magenta, cyan and black by the primary transfer roller 76, and the primarily transferred toner image is then carried toward the secondary transfer section.

The scraper backup roller 84 assists a scraper 94, which will be described later, in scraping off a toner remaining on the intermediate transfer body 74 after the secondary transfer, and the brush backup roller 86 assists a brush roller 96, which will be described later, in scraping off a toner remaining on the intermediate transfer body 74 after the secondary transfer.

The secondary transfer roller 88 and the secondary transfer backup roller 82 of the intermediate transfer device 72 face each other with the conveying path 34 interposed therebetween. Specifically, a position between the secondary transfer roller 88 and the secondary transfer backup roller 82 becomes a secondary transfer position in the secondary transfer section, and the secondary transfer roller 88 secondarily transfers the toner image primarily transferred onto the intermediate transfer body 74 onto a sheet at the secondary transfer position by the assistance of the secondary transfer backup roller 82. Here, the secondary transfer roller 88 is separated from the intermediate transfer body 74 while the intermediate transfer body 74 rotates three times, i.e., while toner images having three colors of yellow, magenta and cyan, respectively, are carried, whereas the secondary transfer roller 88 abuts on the intermediate transfer body 74 when the black toner image has been transferred. Meanwhile, there is a predetermined potential difference between the secondary transfer roller 88 and the secondary transfer backup roller 82. For example, when the secondary transfer roller 88 has a high voltage, the secondary transfer backup roller 82 is connected to a ground (GND) or the like.

Upstream of the secondary transfer position, an image density sensor 90, such as a reflective photosensor, is arranged opposite to the intermediate transfer body 74 with the conveying path 34 interposed therebetween. The image density sensor 90 reads out a patch of a toner formed on the intermediate transfer body 74, and detects the density of the image formed on the intermediate transfer body 74.

A cleaner 92 for an intermediate transfer body is provided to abut on an end of the intermediate transfer body 74 opposite to the image carrier. The cleaner 92 for an intermediate transfer body includes, for example, a scraper 94 which scrapes and cleans a toner remaining on the intermediate transfer body 74 after the secondary transfer, a brush roller 96 which further scrapes a toner remaining after the cleaning by the scraper 94, and a waste toner collecting bottle 98 which collects the toner scraped by the scraper 94 and the brush roller 96. The scraper 94 is made of, for example, a stainless thin plate. A voltage having polarity reverse to that of the toner is applied to the scraper 94. The brush roller 96 has, for example, a brush such as acryl subjected to conductive treatment. Further, while the intermediate transfer body 74 carries a toner image, the scraper 94 and the brush roller 96 are separated from the intermediate transfer body 74, whereas they are integrated with each other at a predetermined timing so as to abut on the intermediate transfer body 74.

A fixing device 100 is arranged above the secondary transfer position. The fixing device 100 has a heating roller 102 and a pressing roller 104, fixes a toner image secondarily transferred onto a sheet by the secondary transfer roller 88 and the secondary transfer backup roller 82 on the sheet, and conveys the sheet toward the discharge roller 40.

Further, a control unit 106 is arranged in the image forming apparatus main body 12 for controlling respective parts that constitute the image forming apparatus 10.

An image carrier unit 108 is constructed by integrating the image carrier 54, the electrifying device 60, and the image carrier cleaner 62 with each other. Further, an image forming unit 110 is constructed by integrating the image carrier unit 108, the intermediate transfer device 72 and the cleaner 92 for an intermediate transfer body with each other. Moreover, a fixing unit 112 is constructed by integrating the fixing device 100 and the discharge roller 40 with each other.

Figure 3:
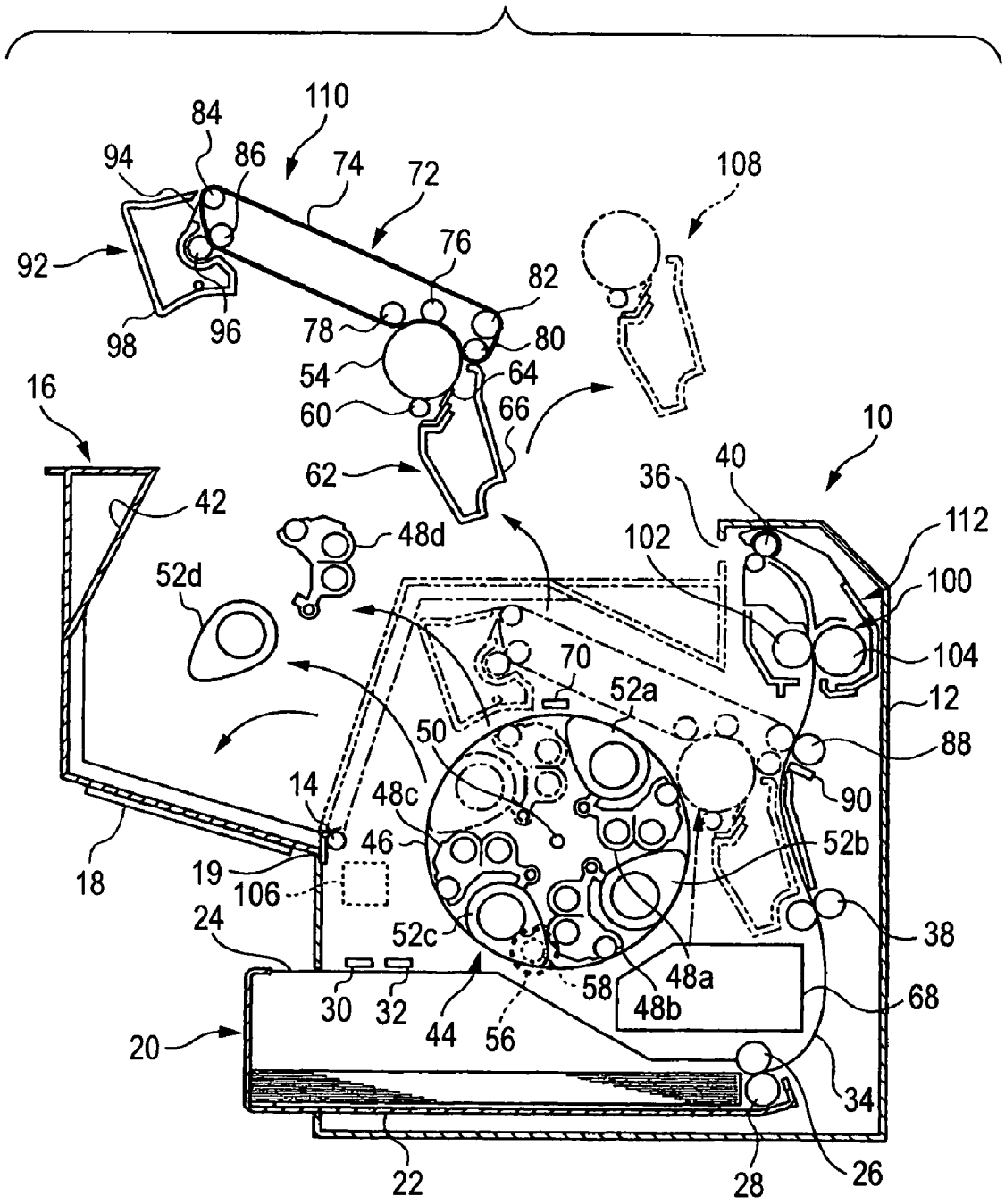
FIG. 3 is a side view exemplarily showing a state in which replaceable units of the image forming apparatus according to the embodiment of the present invention are detached from an image forming apparatus main body.

As also illustrated in FIG. 3, the image forming unit 110 is adapted to be attachable to or detachable from the image forming apparatus main body 12, and is attached to or detached from the image forming apparatus main body by opening the opening and closing cover 16. Further, the image carrier unit 108 is adapted to be attachable to or detachable from the image forming unit 110.

When the opening and closing cover 16 is opened and the toner cartridges 52*a* to 52*d* are positioned on the front side (on the side of the opening and closing cover 16), the toner cartridges 52*a* to 52*d* are adapted to be attachable to or detachable from the developer containers 48*a* to 48*d* mounted in the developer container unit main body 46. When the opening and closing cover 16 is opened and the developer containers 48*a* to 48*d* are located on the front side (on the side of the opening and closing cover 16), the developer containers 48*a* to 48*d* are adapted to be attachable to or detachable from the developer container unit main body 46.

The fixing unit 112 is adapted to be attachable to or detachable from the image forming apparatus main body 12 by detaching a top cover (not shown). Further, other units, such as the developer container unit 44 and the sheet feeding unit 20, are adapted to be attachable to or detachable from the image forming apparatus main body 12.

As such, the respective units can be replaced by a user. On the other hand, in case a user mounts a replaceable unit in the image forming apparatus 10, if the replaceable unit is any one other than a genuine article for the image forming apparatus 10, a problem occurs in that good image quality cannot be maintained and the operation cannot be guaranteed. This is because the image forming apparatus 10 is controlled in accordance with the characteristics of members used for the image forming apparatus 10. Thus, units replaceable by a user are provided with sensors that detect predetermined conditions.

Hereinafter, if any one of a plurality of components, such as the developer containers 48*a* to 48*d*, is not specified, the developer containers are abbreviated as, simply, a "developer container 48".

Next, examples of replaceable units having sensors for detecting predetermined conditions will now be described.

Figure 4:
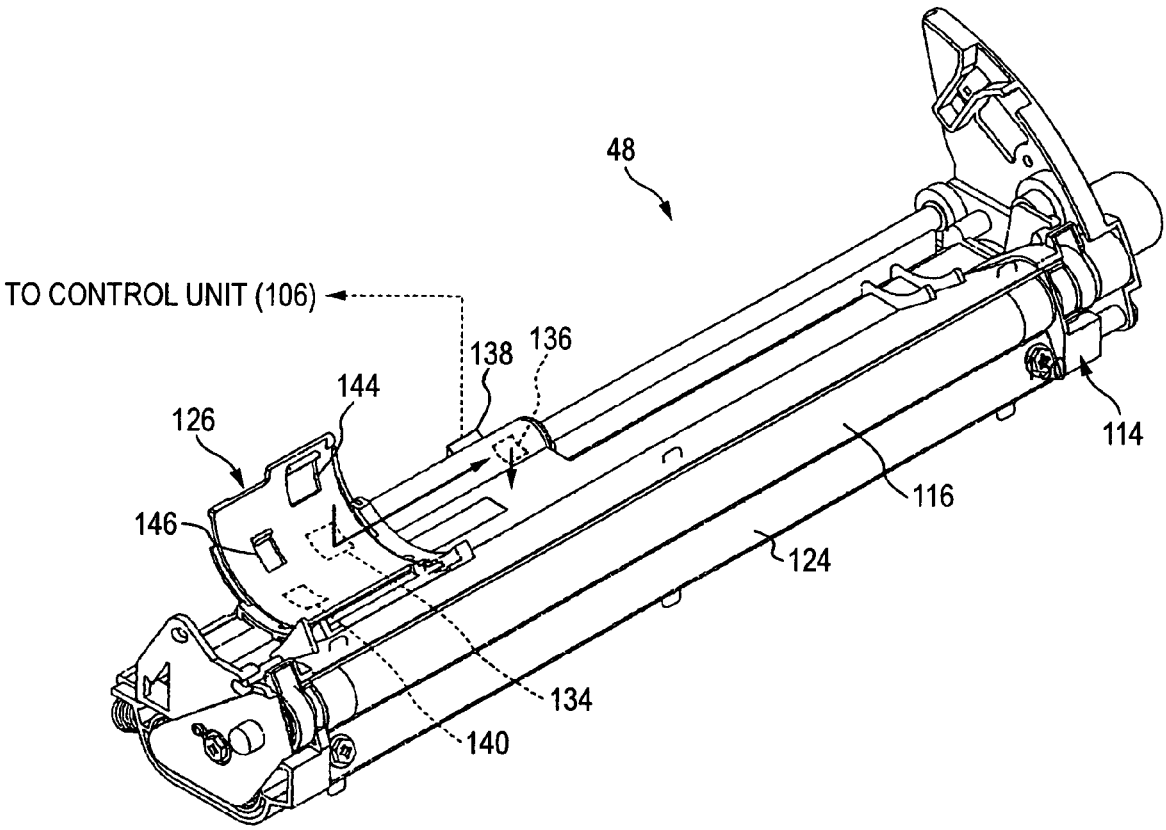
FIG. 4 is a perspective view showing a developer container of the image forming apparatus according to the embodiment of the present invention.
Figure 5:
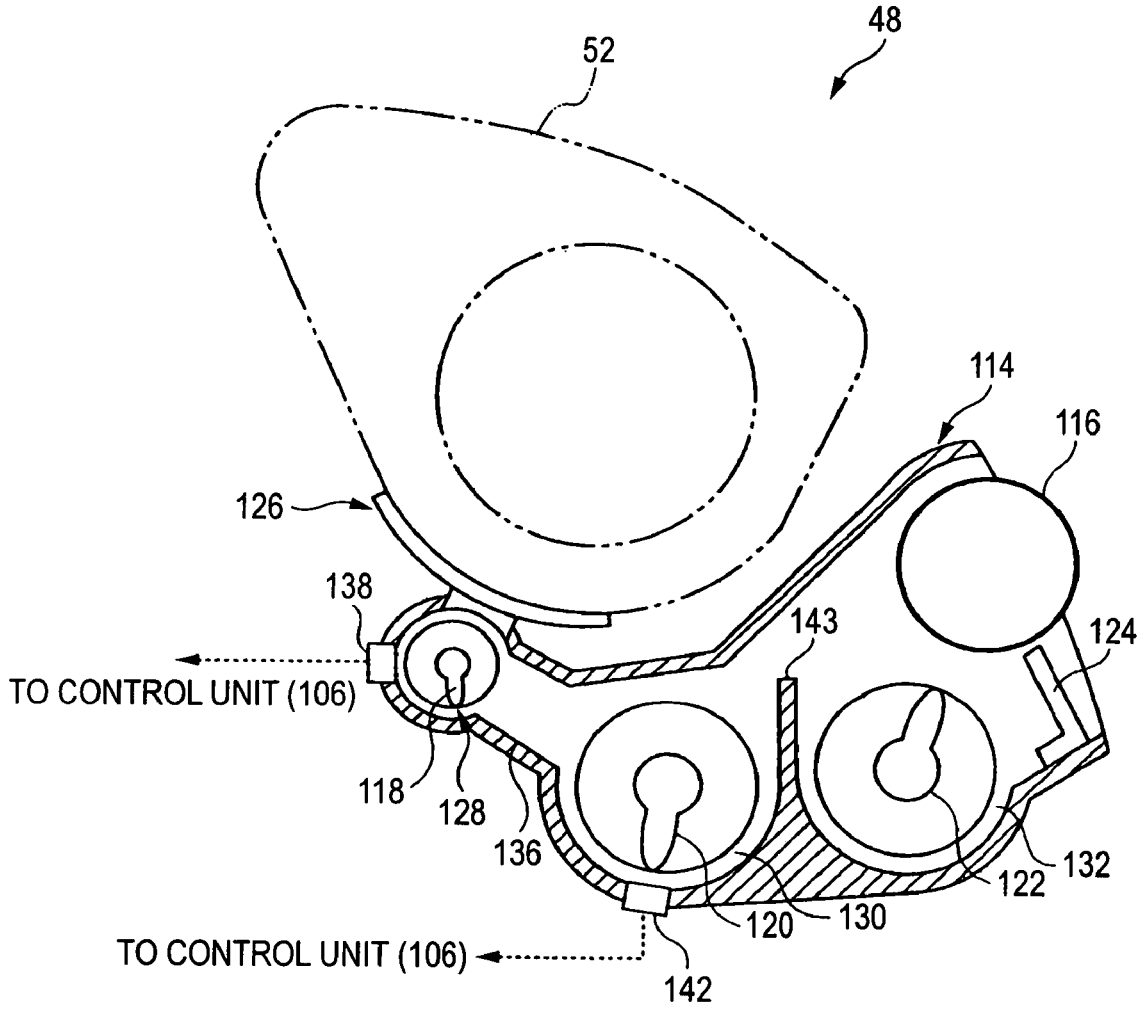
FIG. 5 is a schematic view showing a cross-section of the developer container of the image forming apparatus according to the embodiment of the present invention.

FIGS. 4 and 5 illustrate a construction of a developer container 48 that is a replaceable unit.

The developer container 48 has a developing roller 116 serving as a developer carrier arranged on the image carrier 54 side of a developer container housing (a developer container main body) 114, a first auger 118, a second auger 120, a third auger 122, and a layer thickness regulating member 124. The developer container 48 also contains, for example, a two-component developer consisting of a non-magnetic toner and a magnetic carrier.

The developer container housing 114 has a shutter 126 for opening or closing a toner receiving port 134 and a developer discharge port 140, which will be described later, a tubular take-in conveying path 128 for conveying a toner taken in from the toner cartridge 52, and tubular developer conveying paths 130 and 132 for agitating and conveying a toner and a carrier.

The take-in conveying path 128 has a toner receiving port 134 for receiving a toner from the toner cartridge 52, and a toner feeding port 136 for feeding a toner to the developer conveying path 130. The first auger 118 is arranged in the take-in conveying path 128. The first auger 118 conveys a toner received from the toner cartridge 52 by the take-in conveying path 128, to the developer conveying path 130. Further, the rotation of the first auger 118 is regulated so that the amount of a toner supplied to the developer container 48 from the toner cartridge 52 can be regulated. Thus, a CPU 202 may cumulate the driving time and revolution number of the first auger 118 such that the consumption of a toner (the consumption of the toner cartridge 52) can be calculated. Further, the consumption of a toner may be calculated by storing, as electric charges, currents flowing through the image carrier 54 to a carrier and the like when the exposure device 68 writes an electrostatic latent image in the image carrier 54, and then by allowing the CPU 202 to count the number of times by which the stored electric charges reaches a predetermined amount.

A toner presence/absence detecting sensor 138 is provided in the take-in conveying path 128 between the toner receiving port 134 and the toner feeding port 136. The toner presence/absence detecting sensor 138 detects the presence or absence of a toner in the take-in conveying path 128, for example, by detecting a change in a resistance value depending on the presence or absence of a toner between two points in the take-in conveying path 128. Further, the toner presence/absence detecting sensor 138 may be a piezoelectric element.

The developer conveying path 130 has a developer discharge port 140 for discharging a surplus developer to the toner cartridge 52, and the second auger 120 is arranged in the developer conveying path 130. The second auger 120 agitates a toner conveyed through the take-in conveying path 128, and a carrier, and conveys the resulting mixture to the developer conveying path 132.

The third auger 122 is arranged in the developer conveying path 132. The third auger 122 agitates and conveys a developer through the developer conveying path 130, and supplies the resultant to the developing roller 116.

Meanwhile, a partition plate 143 is provided between the developer conveying path 130 and the developer conveying path 132. Passageways (not shown) are provided at both ends of the partition plate 143 for connecting the developer conveying path 130 and the developer conveying path 132. Thus, the second auger 120 and the third auger 122 convey a developer in directions different from each other so that a toner can be frictionally electrified so as to have predetermined polarity and electric charge quantity by the carrier and can be circulated in the developer container housing 114. Further, a deteriorated developer is discharged to the toner cartridge 52 from the developer discharge port 140 at a predetermined timing so that the total lifetime of the developer can be prolonged (a trickle development method).

The shutter 126 has openings 144 and 146. The opening 144 is overlapped with the toner receiving port 134 to form a passageway for a toner from the toner cartridge 52 to the developer container 48, and the opening 146 is overlapped with the developer discharge port 140 to form a passageway for a surplus developer from the developing container 48 to the toner cartridge 52.

The developing roller 116 abuts on the image carrier 54 while carrying a toner, thereby developing an electrostatic latent image carried by the image carrier 54 with the toner. The layer thickness regulating member 124 regulates the layer thickness of a toner carried by the developing roller 116.

Figure 6:
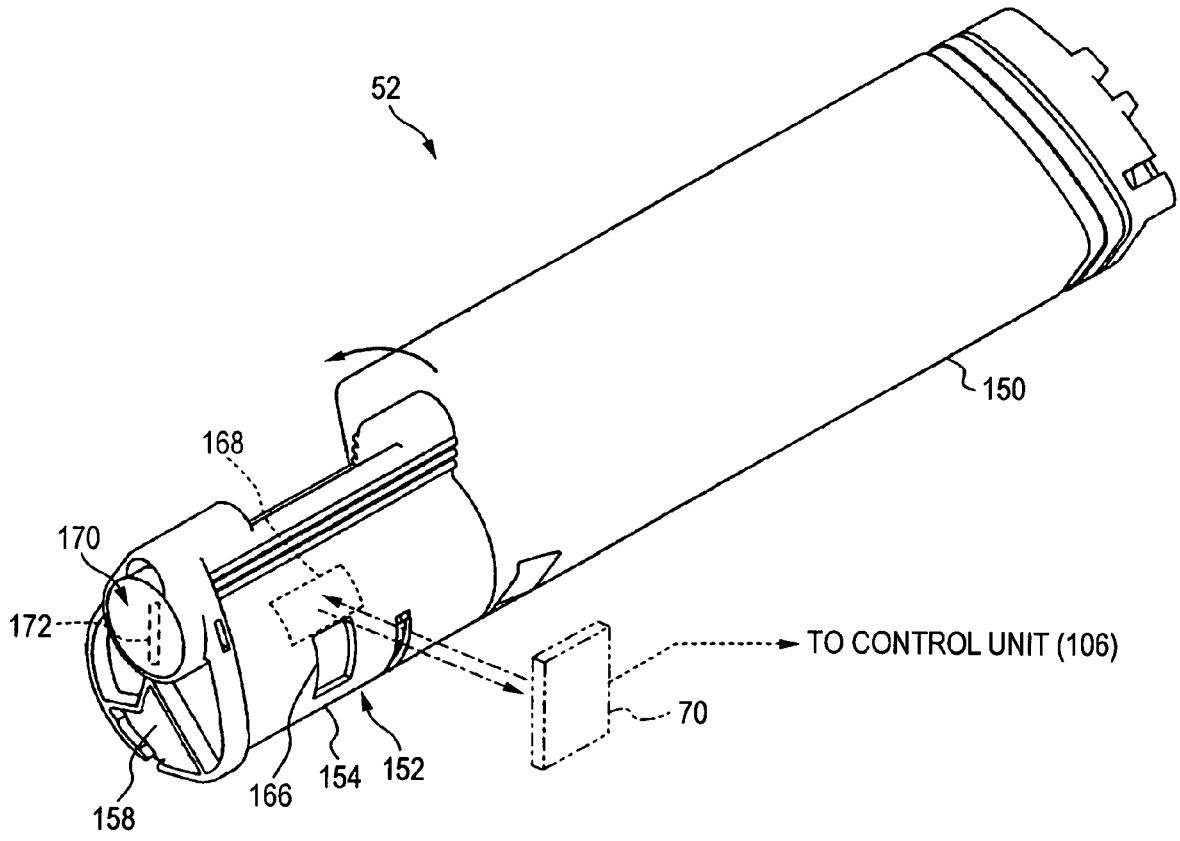
FIG. 6 is a perspective view showing a toner cartridge of the image forming apparatus according to the embodiment of the present invention.
Figure 7:
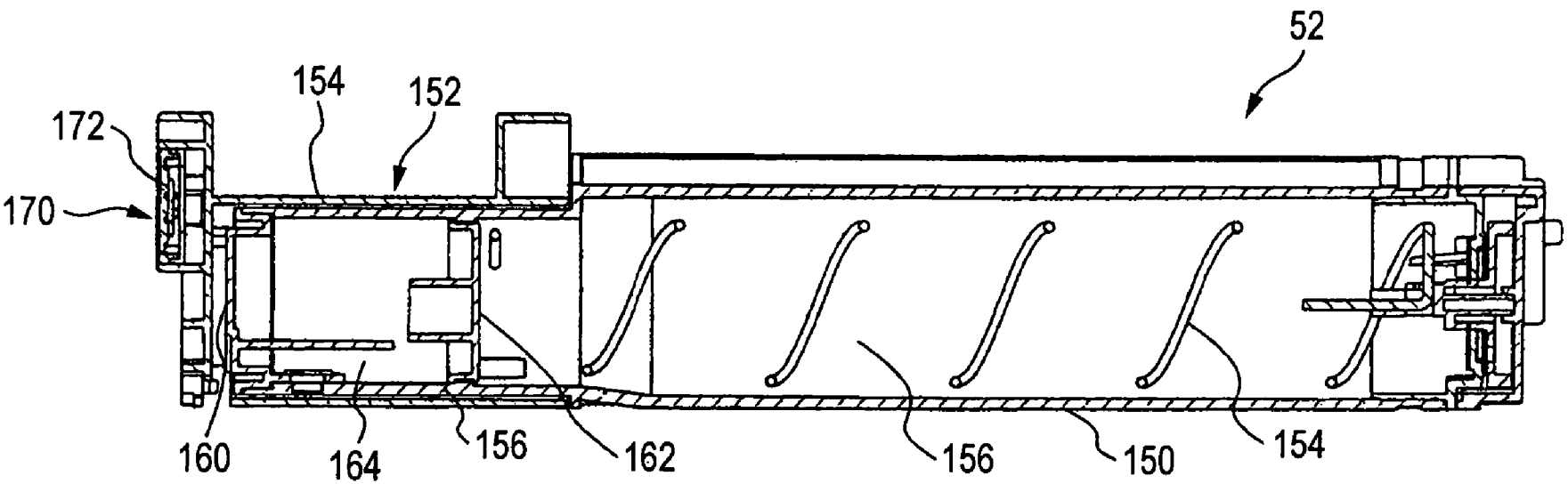
FIG. 7 is a cross-sectional view showing of the toner cartridge of the image forming apparatus according to the embodiment of the present invention.

FIGS. 6 and 7 illustrate a construction of the toner cartridge 52 that is a replaceable unit.

The toner cartridge 52 has a toner cartridge main body 150, and a rotating member 152 provided at a longitudinal end of the toner cartridge main body 150.

The toner cartridge main body 150 is formed in a tubular shape, and is formed such that a substantially cylindrical portion having an agitating and conveying member 154 arranged therein and a portion extending from the substantially tubular portion in a direction substantially perpendicular to its longitudinal direction so as to be gradually narrowed are integrated with each other. Further, when the toner cartridge 52 is mounted in the developer container unit main body 46 via the developer container 48, the toner cartridge main body 150 is configured such that its outer surface substantially coincides with the outer circumference of the developer container main body 46.

A toner accommodating space 156 is formed in the toner cartridge main body 150 for accommodating a toner to be supplied to the developer container 48. The above-mentioned agitating and conveying member 154 is provided in the toner accommodating space 156. The agitating and conveying member 154 is wound in, for example, a spiral shape, and agitates a toner in the toner accommodating space 156 and conveys the agitated toner toward the toner receiving port 134 of the developer container 48.

The rotating member 152 has a rotating member main body 154, and a cylindrical tubular part 156 provided in the rotating member main body 154 and integrally formed with the toner cartridge main body 150. The tubular part 156 is sealed up at a lateral face 158 of the rotating member main body 154 by a tubular part sidewall 160, and has an isolating wall 162 provided therein. A developer collecting space 164 for collecting a surplus developer from the developer container 48 is formed at the side of the isolating wall 162 facing the tubular part sidewall 160, and the above-mentioned toner accommodating space 156 is formed to extend at the side of the isolating wall 162 opposite to the tubular part sidewall 160.

The rotating member main body 154 has a window 166 covered with a transparent member, and has the inner surface thereof formed in a cylindrical shape to rotate along the outer surface of the cylindrical portion of a tubular part 156. Further, a reflecting member 168, such as a white tape, is attached to the outer surface of the cylindrical portion of the tubular part 156. When the toner cartridge 52 is mounted in the developer container 48 and the rotating member main body 154 rotates, the reflecting member 168 is exposed through the window 166. Further, when the developer container unit 44 having the toner cartridge 52 mounted therein rotates in the image forming apparatus main body 12, the exposed reflecting member 168 passes through a position which faces the unused state detecting sensor 70 fixed to the image forming apparatus main body 12. As described above, the unused state detecting sensor 70 is, for example, a reflective photosensor. When the reflecting member 168 of the toner cartridge 52 mounted in the developer container unit 44 passes through a position which faces the unused state detecting sensor 70, the unused state detecting sensor 70 detects the quantity of reflection of the reflecting member 168 which varies depending on dirt by a toner, thereby detecting whether or not the toner cartridge 52 is unused.

A memory chip 170 is attached to the lateral face 158 of the rotating member main body 154. The memory chip 170 has an antenna 172, and performs wireless communication with the wireless communication unit 56 provided on the image forming apparatus main body 12.

Next, regarding the wireless communication unit 56 and the memory chip 170, a circuit configuration of each thereof and communication performed therebetween will now be described.

Figure 8:
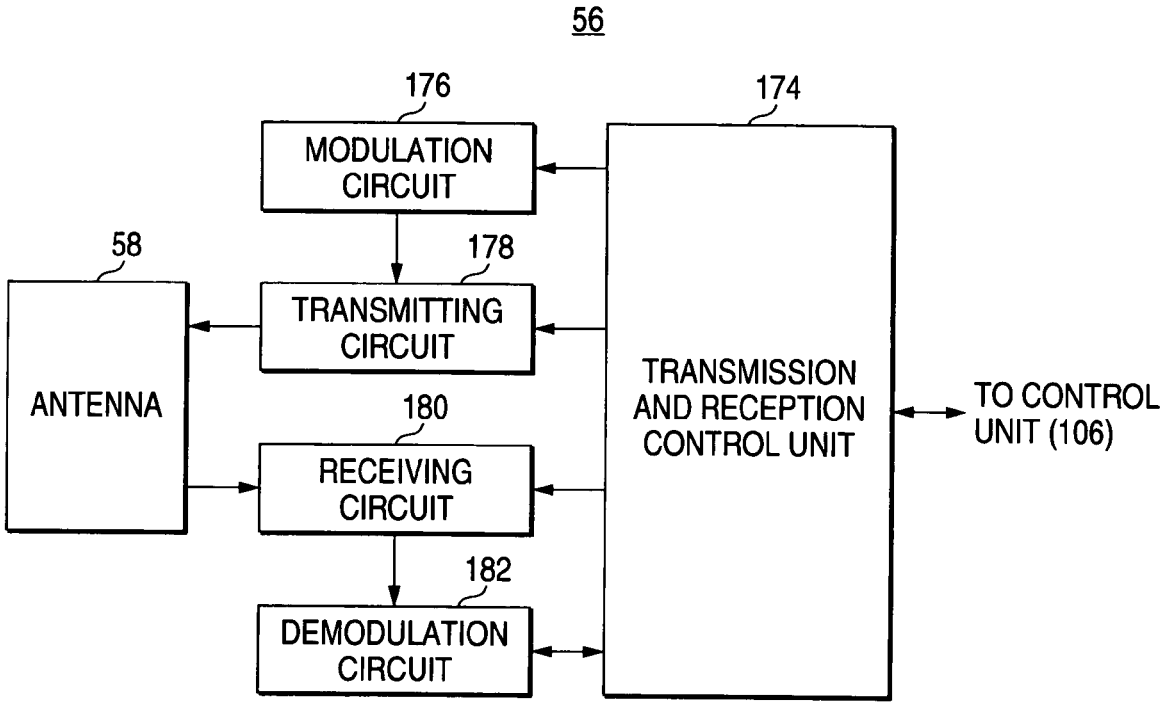
FIG. 8 is a block diagram showing a circuit configuration of a wireless communication unit of the image forming apparatus according to the embodiment of the present invention.
Figure 9:
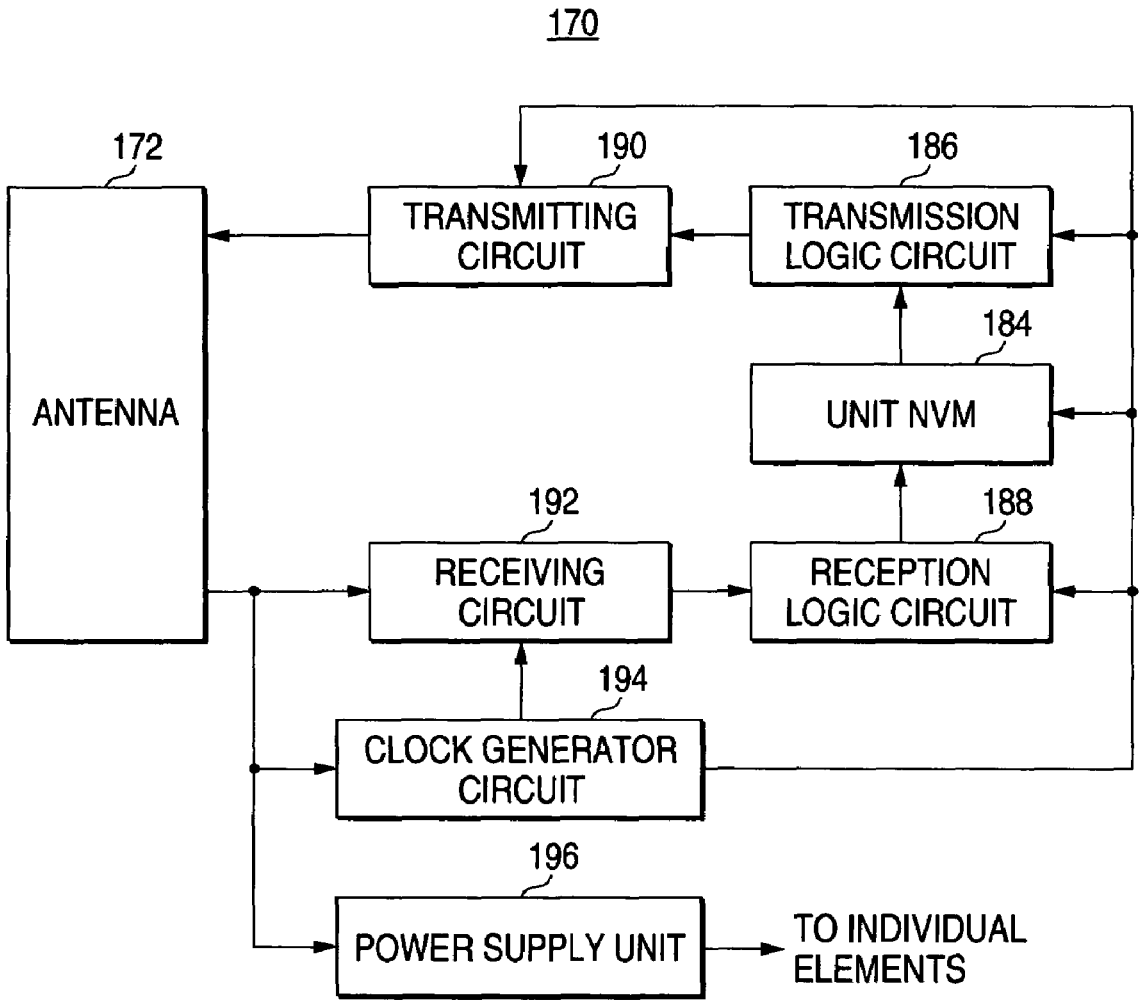
FIG. 9 is a block diagram showing a circuit configuration of a memory chip of a toner cartridge used for the image forming apparatus according to the embodiment of the present invention.

FIG. 8 is a block diagram showing a circuit configuration of the wireless communication unit 56. FIG. 9 is a block diagram showing a circuit configuration of the memory chip 170.

As illustrated in FIG. 8, a circuit of the wireless communication unit 56 includes a transmission and reception control unit 174, a modulation circuit 176, a transmitting circuit 178, a receiving circuit 180, a demodulation circuit 182, and an antenna 58. In the wireless communication unit 56, the transmission and reception control unit 174 controls the operation of the respective components of the wireless communication unit 56. Also, the transmission and reception control unit 174 outputs data input from the control unit 106 to the demodulation circuit 176. Further, the transmission and reception control unit 174 outputs data received by the receiving circuit 180 and demodulated by the demodulation circuit 182 to the control unit 106. The modulation circuit 176 modulates data input from the transmission and reception control unit 174 and outputs the modulated data to the transmitting circuit 178. The transmitting circuit 178 outputs radio signals, including data and clock signals to be stored in the memory chip 170, to the memory chip 170 via the antenna 58.

The receiving circuit 180 receives signals transmitted from the memory chip 170 via the antenna 58, and outputs the received signals to the demodulation circuit 182. The demodulation circuit 182 demodulates data transmitted by the memory chip 170 depending on a change in the signals input from the receiving circuit 180, and outputs the demodulated data to the transmission and reception control unit 174.

As illustrated in FIG. 9, a circuit of the memory chip 170 includes a unit nonvolatile memory (NVM) 184, a transmission logic circuit 186, a reception logic circuit 188, a transmitting circuit 190, a receiving circuit 192, a clock regenerator circuit 194, a power supply unit 196, and an antenna 172.

When radio signals are transmitted from the wireless communication unit 56 to the memory chip 170, the receiving circuit 192, the clock regenerator circuit 194 and the power supply unit 196 receive the radio signals via the antenna 172. In the memory chip 170, when the radio signals were received, the power supply unit 196 rectifies a current caused by the electromagnetic induction by the radio signals, and supplies electric power required for the operation of the respective components of the memory chip 170 to the components. For example, when a voltage higher than that generated by the power supply unit 196 is required, the memory chip 170 may be configured to receive the power supplied from the main body 40. For example, power may be supplied in a non-contact way from an alternating current supplied to the developer container unit 44 by further providing the memory chip 170 with power supply coils or the like.

When the clock regenerator circuit 194 receives the radio signals, it regenerates clock signals and outputs the regenerated clock signals to the respective circuits which constitute the memory chip 170. When the receiving circuit 192 receives the radio signals, it outputs signals, such as data included in the radio signals, to the reception logic circuit 188 in synchronization with the clock signals input from the clock regenerator circuit 194. The reception logic circuit 188 demodulates signals, such as data input from the receiving circuit 192, in synchronization with the clock signals input from the clock regenerator circuit 194, and outputs the demodulated signals to the unit NVM 184.

The unit NVM 184 is a writable nonvolatile memory. When signals input from the reception logic circuit 188 in synchronization with the clock signals input from the clock regenerator circuit 194, indicate write-in of data, the unit NVM 184 performs write-in (storing) of the data, and when the signals indicate readout of data, the unit NVM 184 outputs the data stored in the unit NVM 184 to the transmission logic circuit 186. A nonvolatile memory included in the unit NVM 184 may be, for example, a flash read-only memory (flash ROM), an electrically erasable programmable read-only memory (EEPROM), or a ferroelectric random access memory (FeRAM).

The transmission logic circuit 186 modulates data input from the unit NVM 184 in synchronization with the clock signals input from the clock regenerator circuit 194, and outputs the modulated data to the transmitting circuit 190. The transmitting circuit 190 transmits the signals input from the transmission logic circuit 186 to the wireless communication unit 56 via the antenna 172 as radio signals, in synchronization with the clock signals input from the clock regenerator circuit 194.

Meanwhile, signals transmitted or received as the radio signals may be converted into radio signals after their encryption, and may then be transmitted or received. Further, for example, authorized users may rewrite the contents in the unit NVM 184 through any device other than the control unit 106, using encrypted radio signals.

Figure 10:
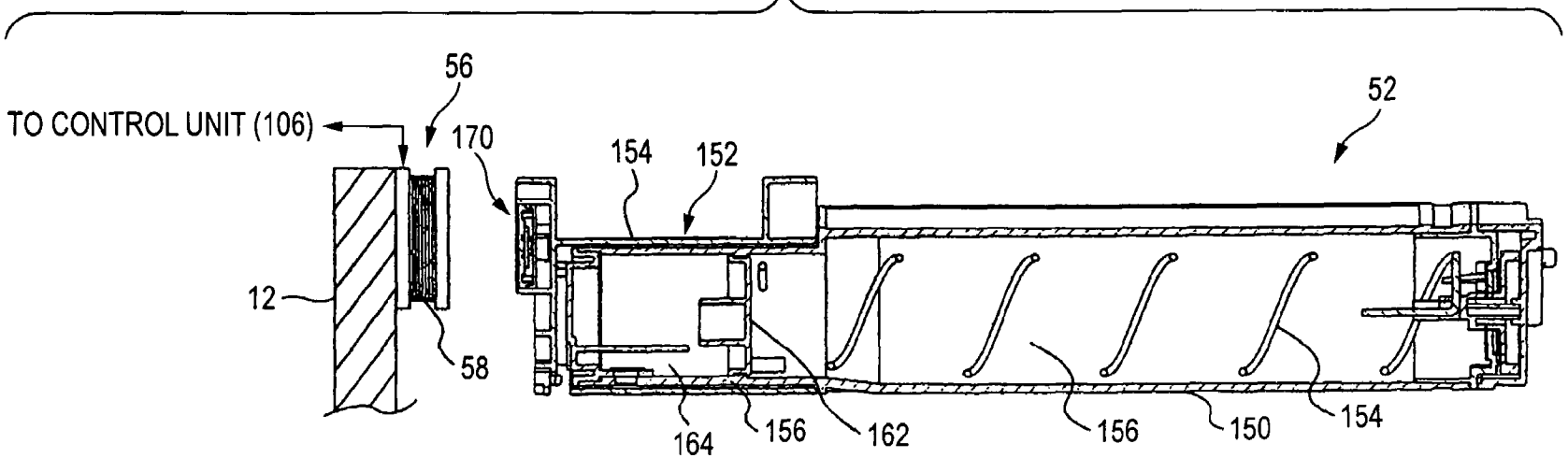
FIG. 10 is a cross-sectional view showing a positional relationship between the wireless communication unit and the memory chip which are performing wireless communication.

FIG. 10 illustrates a positional relationship between the wireless communication unit 56 and the memory chip 170 which perform wireless communication. As described above, the toner cartridge 52 is mounted in each developer container 48, and moves while the developer container unit 44 (FIG. 2) rotates about the rotating shaft 50. The wireless communication unit 56 is fixed to the image forming apparatus main body 12 in the vicinity of the lateral side of the developer container unit 44 so as to sequentially substantially face the memory chips 170 moved by the rotation of the developer container unit 44. The wireless communication unit 56 is also adapted to perform wireless communication in its halting state in which the movement of the developer container 48 is controlled at a position which substantially faces any one of the memory chips 170 so as to perform wireless communication with the facing memory chip 170. Further, the wireless communication unit 56 is adapted to receive acknowledge signals transmitted by the memory chip 170 in response to, for example, radio signals output by the wireless communication unit 56, so as to confirm the start of transmission or reception of data.

Figure 11:
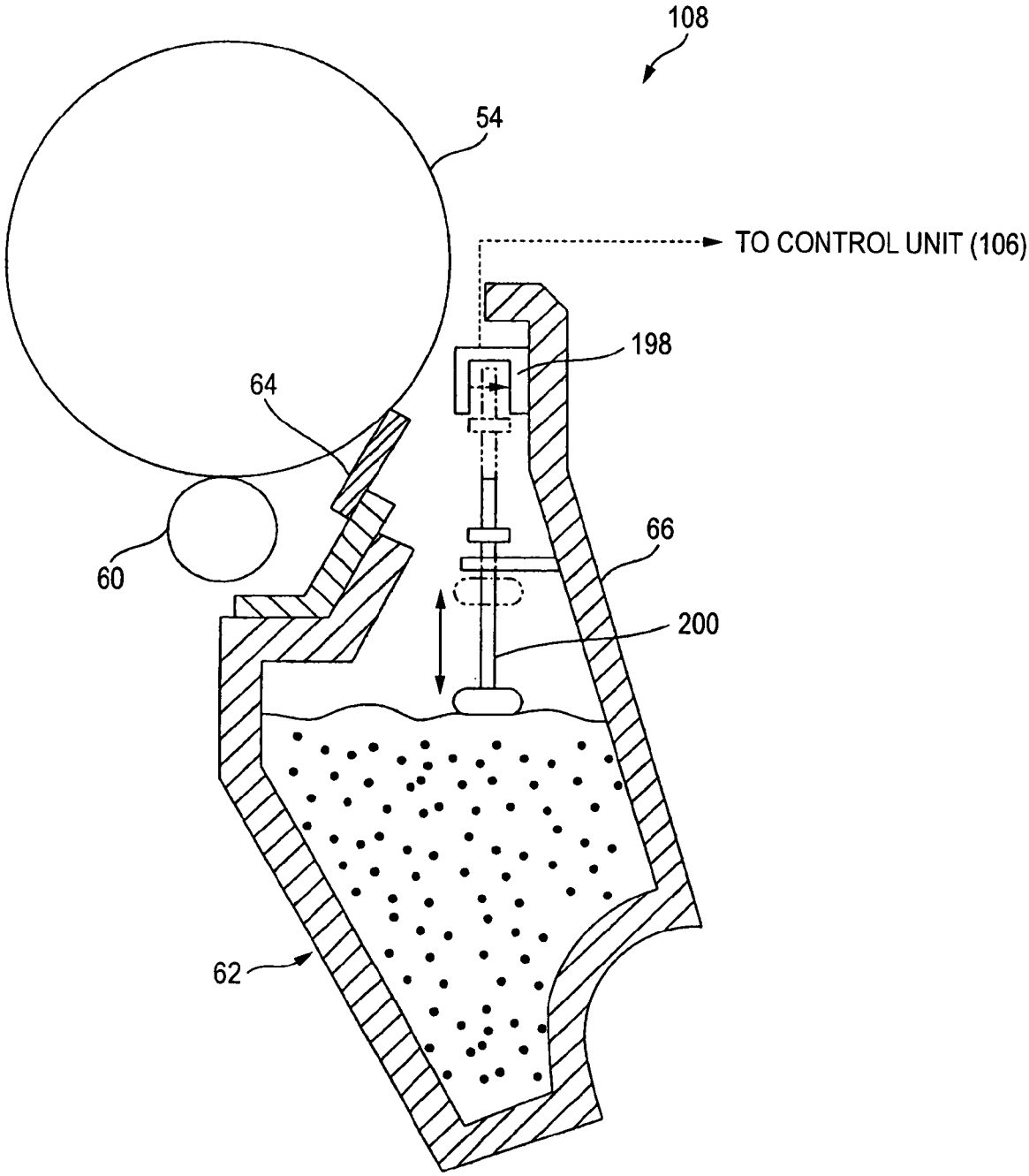
FIG. 11 is a side view showing a configuration of an image carrier unit used for the image forming apparatus according to the embodiment of the present invention.

FIG. 11 illustrates a configuration of the image carrier unit 108 that is a replaceable unit.

As describe above, the image carrier unit 108 is constructed by integrating the image carrier 54, the electrifying device 60 and the image carrier cleaner 62 with each other. For example, the image carrier unit 108 has a waste toner fullness sensor 198 arranged in the image carrier cleaner 62 at the upper portion thereof, and a float 200 arranged below the waste toner fullness sensor 198. The waste toner fullness sensor 198 has an optical path configured such that light emitted by a light-emitting part provided at one side is received by a light-receiving part provided at the other side, and outputs whether or not the light-receiving part has received the light, to the control unit 106. The float 200 is adapted to rise when a waste toner collected in the waste toner collecting bottle 66 from the image carrier 54 exceeds a predetermined amount, and is adapted to intercept the optical path of the waste toner fullness sensor 198 when the waste toner collecting bottle 66 is full of a waste toner. As such, the image carrier unit 108 detects whether or not the waste toner collecting bottle 66 becomes full by means of the waste toner fullness sensor 198 and the float 200, and outputs the detected result to the control unit 106.

Further, the waste toner fullness sensor 198 and the float 200 may be provided in the cleaner 92 for an intermediate transfer body to detect whether or not the waste toner collecting bottle 98 becomes full.

As such, a replaceable unit which has a sensor or the like for detecting predetermined conditions is adapted to output results detected by the sensor or the like to the control unit 106, and the control unit 106 controls the respective components which constitute the image forming apparatus 10 on the basis of the input detected results.

Moreover, the image carrier unit 108 may be provided with a memory chip. In this case, the image forming apparatus 10 is provided with a wireless communication unit (similar to the wireless communication unit 56 shown in FIG. 8) to be disposed in the vicinity of the memory chip provided in the image carrier unit 108. The memory chip provided in the image carrier unit 108 has the same configuration as that of the memory chip 170 shown in FIG. 9. Further, when the image carrier unit 108 is mounted to the image forming apparatus main body, the memory chip transmits or receives signals with the wireless communication unit under the control of the CPU 202.

Next, a construction of the control unit 106 will be described in detail.

Figure 12:
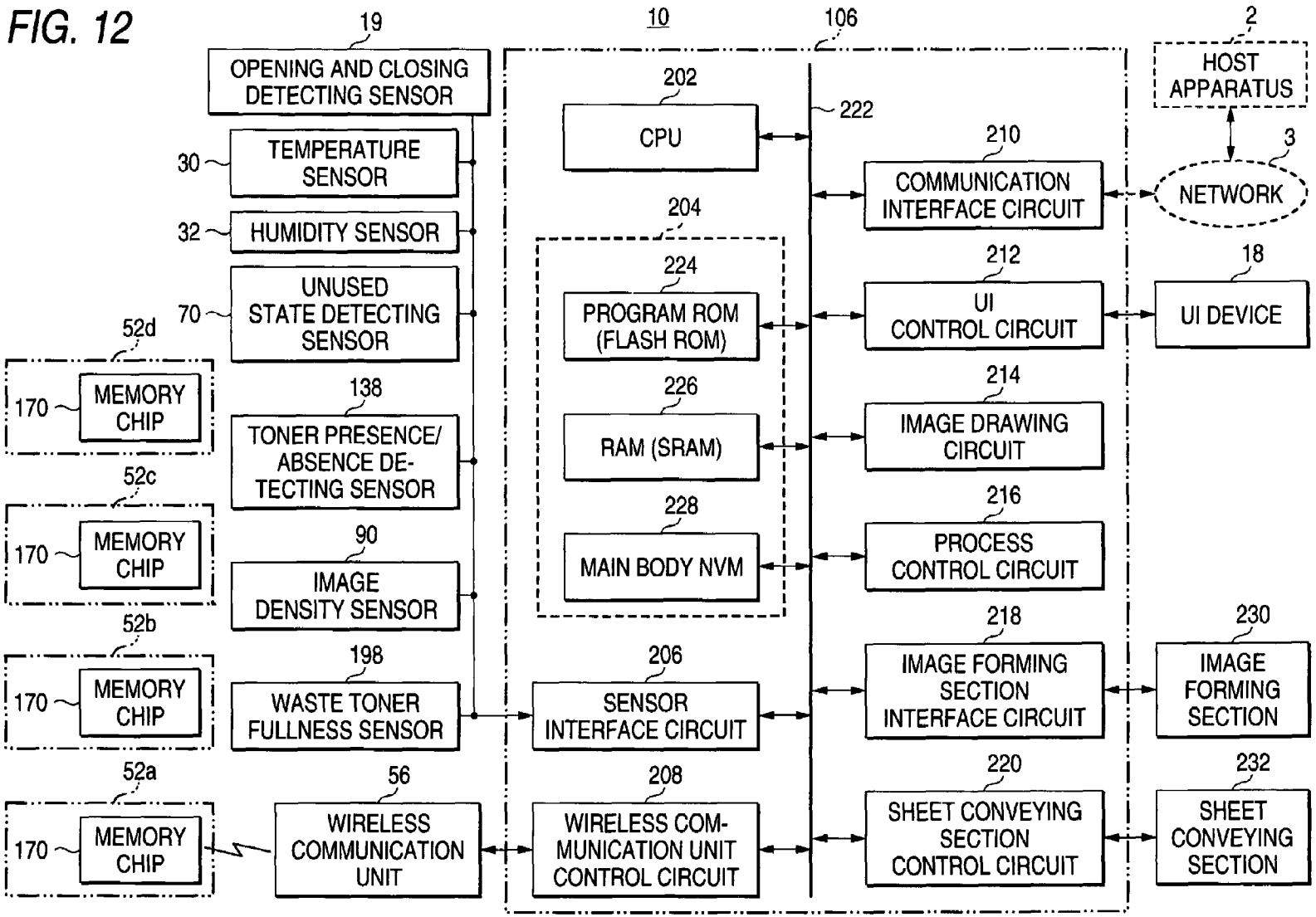
FIG. 12 is a block diagram showing a configuration of a control unit of the image forming apparatus according to the embodiment of the present invention, and respective elements connected to the control unit.

FIG. 12 is a block diagram showing a configuration of the control unit 106 and respective components connected to the control unit 106.

The control unit 106 has a CPU 202, a storage unit 204, a sensor interface (sensor I/F) circuit 206, a wireless communication unit control circuit 208, a communication interface (communication I/F) circuit 210, a user interface (UI) control circuit 212, an image drawing circuit 214, a process control circuit 216, an image forming section interface (image forming I/F) circuit 218, and a sheet conveying section control circuit 220. These components are configured to be capable of inputting or outputting signals via a system bus 222.

The CPU 202 transmits or receives signals between the respective components, which constitute the control unit 106, via the system bus 222, and controls the respective components which constitute the control unit 106.

The storage unit 204 has a program ROM 224, a RAM 226 and a main body nonvolatile memory (NVM) 228, and stores information required for controlling the image forming apparatus 10, and the like. The program ROM 224 may have, for example, a flash ROM, and the contents stored in the program ROM 224 may be updated. The RAM 226 may have, for example, an SRAM, and stores temporary information, such as drawing data inputted from the image drawing circuit 214. The main body NVM 228 has, for example, an electrically rewritable nonvolatile memory, such as an EEPROM or a flash ROM. Meanwhile, the main body NVM 228 is a rewritable storage device, and it may be an SRAM, a hard disc drive (HDD) or an optical memory whose power is backed up by, for example, a battery, as long as it can hold data even if the image forming apparatus 10 is powered off.

The sensor I/F circuit 206 receives results detected by the opening and closing detecting sensor 19, the temperature sensor 30, the humidity sensor 32, the unused state detecting sensor 70, the toner presence/absence detecting sensor 138, the image density sensor 90 and the waste toner fullness sensor 198, respectively, and outputs the detected results to the CPU 202 via the system bus 222. The wireless communication unit control circuit 208 transmits or receives signals with the four memory chips 170 respectively provided in the toner cartridges 52*a* to 52*d* via the wireless communication unit 56, transmits or receives signals with the CPU 202, the storage unit 204 and the like, via the system bus 222, and connects the respective memory chips 170 with the CPU 202, storage unit 204 and the like.

The communication I/F circuit 210 transmits or receives signals with the host apparatus 2 via the network 3, transmits or receives signals with the CPU 202 and the like via the system bus 222, and connects the host apparatus 2 with the CPU 202 and the like. The UI control circuit 212 transmits or receives signals with the UI device 18, transmits or receives signals with the CPU 202 and the like via the system bus 222, and connects the UI device 18 with the CPU 202 and the like.

The image drawing circuit 214 draws an image on the basis of image forming signals inputted from the host apparatus 2 or the like, and outputs the drawn image to the CPU 202 and the RAM 226. The process control circuit 216 along with the CPU 202 refers to set values, which will be described later, stored in the storage unit 204, and controls an image forming section 230, including the exposure device 68, the image forming unit 110, the developer container unit 44 and the like, via the image forming section I/F circuit 218. The sheet conveying section control circuit 220 along with the CPU 202 controls a sheet conveying section 232, including the feeding roller 26, the retard roller 28, the resist roller 38 and the like.

Meanwhile, since the CPU 202 can compare the data stored in the storage unit 204 with the data stored in the unit NVM 184, and then determine the state of the toner cartridge 52 having the memory chip 170 thereto, the memory chip 170 constitutes a part of detecting unit, even if it does not have any sensor.

Next, data that is stored in the program ROM 224, the main body NVM 228 and the unit NVM 184 will now be described in detail.

Figure 13:
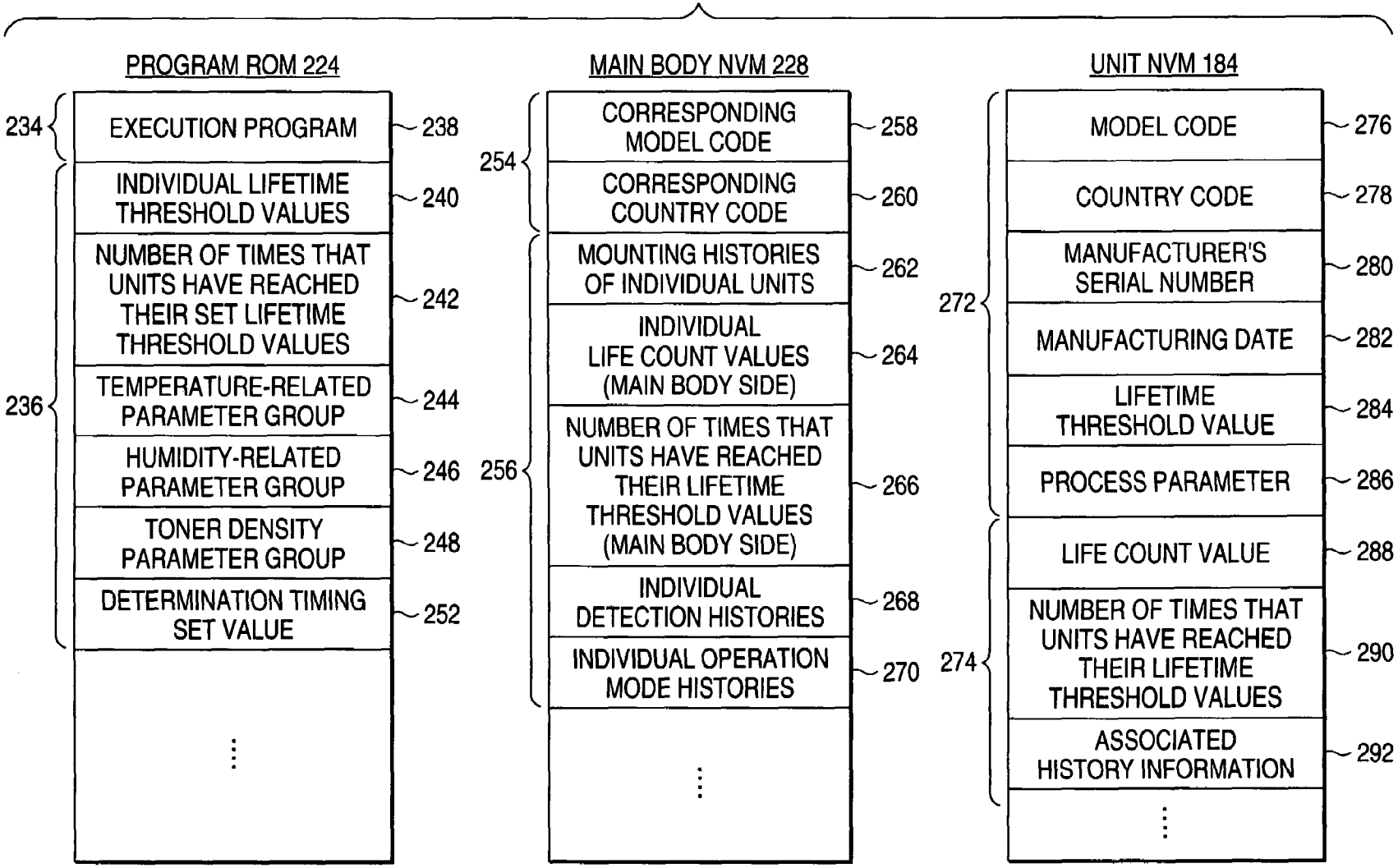
FIG. 13 is a memory map exemplarily showing data which are stored in a program ROM, a main body NVM, and a unit NVM.

FIG. 13 illustrates an example of the data stored in the program ROM 224, the main body NVM 228 and the unit NVM 184.

The program ROM 224 is provided with a program region 234, a set value region 236, and the like. The program region 234 stores an execution program 238 for operating the image forming apparatus 10. The set value region 236 stores individual lifetime threshold values 240, number of times that units reached their set lifetime threshold values 242, a temperature-related parameter group 244, a humidity-related parameter group 246, a toner density parameter group 248, and determination timing set values 252.

The individual lifetime threshold values 240 include the lifetime (lifetime threshold values) of individual replaceable units of the image forming apparatus 10. The number of times that units have reached their set lifetime threshold values 242 include the number of times which allows the individual replaceable units of the image forming apparatus 10 to arrive at individual threshold values thereof. The temperature-related parameter group 244 includes individual parameters related to the control of the temperature of the image forming apparatus 10. The humidity-related parameter group 246 includes individual parameters related to the control of the humidity of the image forming apparatus 10. The toner density parameter group 248 includes individual parameters related to the control of the density of a toner in the developer container 48. The determination timing set values 252 include a period of time (determination timing) which is taken until the CPU 202 starts to determine whether or not the individual replaceable units of the image forming apparatus 10 are genuine in a process (FIGS. 17A and 17B) or the like in which the image forming apparatus 10 performs printing preparation fit to an operation mode, which will be described later.

The main body NVM 228 is provided with a corresponding unit information region 254 and a main-body-side update region 256, and the like.

The corresponding unit information region 254 stores corresponding model codes 258 and corresponding country codes 260. The corresponding model codes 258 store a table (data) of models showing whether each of the individual replaceable units of the image forming apparatus 10 is a model which matches with the image forming apparatus 10. The corresponding country codes 260 store a table (data) of individual countries which sets specifications different in each country for the individual replaceable units of the image forming apparatus 10.

The main-body-side update region 256 stores mounting histories 262 of individual units, individual life count values 264 on the main body side, number of times that units have reached their lifetime threshold values 266 on the main body side, individual detection histories 268, individual operation mode histories 270, and the like. The individual unit mounting histories 262 include mounting histories of individual replaceable units of the image forming apparatus 10. The individual life count values 264 on the main body side include individual life count values (consumption up to the present time from the time when replaceable units begin to be used) of individual replaceable units of the image forming apparatus 10. Meanwhile, the consumption of the individual units may be calculated from the cumulative operation time or the like of each of the individual units. The number of times that units have reached their lifetime threshold values 266 on the main body side includes number of times that individual replaceable units of the image forming apparatus 10 have reached their lifetime threshold values. The individual detection histories 268 include histories of detection results detected by respective sensors or the like provided in the image forming apparatus 10. The individual operation mode histories 270 include histories of operation modes applied to individual replaceable units of the image forming apparatus 10.

Moreover, the image forming apparatus 10 stores an operation mode (a default mode S) corresponding to the genuine article as an initial value of the individual operation mode histories 270 and, when an operation mode is selected by the user, adds the selected operation mode. Further, when the same operation mode as the latest operation mode is selected by the user, the image forming apparatus 10 overwrites the operation mode to the latest operation mode. Further, the individual operation mode histories 270 include reservation information of an operation mode. That is, the image forming apparatus 10 stores the reservation information (a reserved operation mode) received from the user in the main-body-side update region 256 as a temporary operation mode history 270 and, when a replacement of a unit is detected, converts the reserved operation mode into a formal entry of the operation mode history 270.

The unit NVM 184 is provided with a unit information region 272, a unit-side update region 274, and the like.

The unit information region 272 stores model codes 276 indicating a model, country codes 278 indicating a country in which the specification of a model is set, manufacturer's serial numbers 280 and manufacturing dates 282, which are unique to the individual units, lifetime threshold values 284 indicating lifetime of the unit, process parameters 286 for process control, and the like.

The unit-side update region 274 stores life count values 288 showing the consumption of the toner cartridge 52 up to the present time from the time when the toner cartridges being to be used, number of times that units have reached their lifetime threshold values 290 showing the number of times which arrives at a lifetime threshold value stored in the lifetime threshold values 284, associated history information 292, and the like. Meanwhile, the associated history information 292 includes histories of associated information, such as the number of revolutions of the image carrier 54, available for grasping the state of the toner cartridge 52.

Next, a reservation management module 500 which is stored in the program ROM 224 and constitutes a portion of the execution program 238 will be described.

Figure 14:
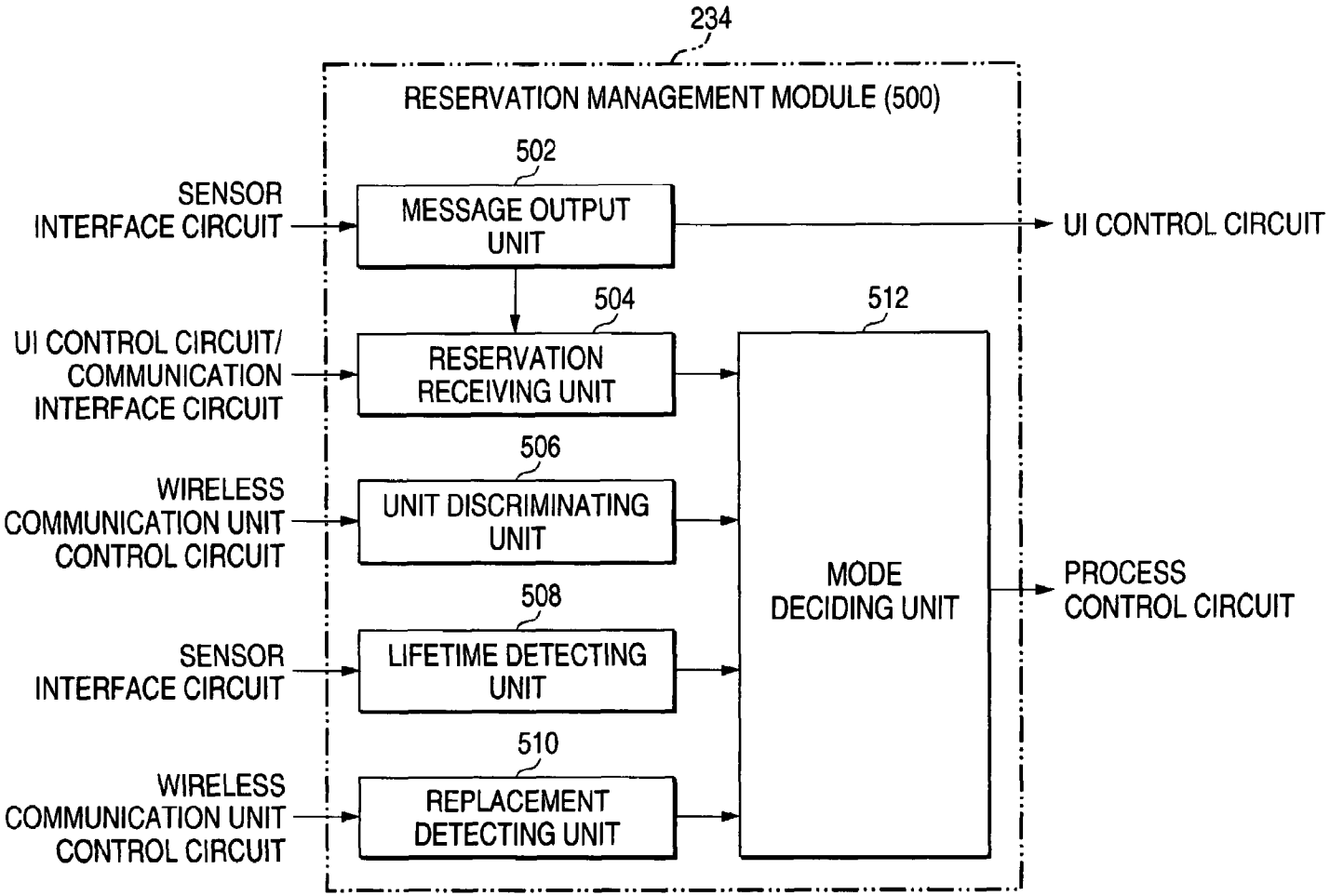
FIG. 14 is a diagram showing a functional configuration of a reservation management module 500 which is stored in the program ROM 224 and constitutes a portion of an execution program 238.

FIG. 14 shows a functional configuration of the reservation management module 500.

The reservation management module 500 has a message output unit 502, a reservation receiving unit 504, a unit discriminating unit 506, a lifetime detecting unit 508, a replacement detecting unit 510, and a mode deciding unit 512.

The message output unit 502 displays a reservation start message which urges a reservation of an operation mode at the timing according to the consumption of each replaceable unit. More specifically, based on the toner presence/absence information acquired via the sensor I/F circuit 206 (FIG. 12), the message output unit 502 determines whether or not it is a replacement alert timing at which it should be notified that a replacement timing of the toner cartridge 52 is close in time. If it is determined that it is the replacement alert timing, the message output unit 502 display the reservation start message on the UI device 18 via the UI control circuit 212 (FIG. 12). That is, the image forming apparatus 10 displays the reservation start message when the replacement timing of the replaceable unit such as the toner cartridge is close in time and urges the user to reserve the operation mode to be set with respect to a replaceable unit which is to be mounted next. Moreover, the message output unit 502 may determine the replacement alert timing based on the life count value 264 (288) and the lifetime threshold value 284.

The reservation receiving unit 504 receives an operation mode selected by the user as a reservation of an operation mode and outputs the received reservation to the mode deciding unit 512. More specifically, the reservation receiving unit 504 acquires identification information of the operation mode selected by the user via the UI control circuit 212 (FIG. 12) and outputs the acquired identification information of the operation mode to the mode deciding unit 512 as reservation information. Moreover, the reservation receiving unit 504 in the present example confirms an operation mode selected in an operation mode reservation screen as the reservation of the operation mode.

The unit discriminating unit 506 discriminates whether or not a mounted unit is a genuine article and outputs the discrimination result to the mode deciding unit 512. More specifically, the unit discriminating unit 506 acquires the information, which is stored in the unit NVM 184 (FIG. 13), via the wireless communication unit control circuit 208 (FIG. 12) and, based on the acquired information, discriminates whether the unit which is being mounted is the genuine article.

The lifetime detecting unit 508 detects that a usable time of the mounted unit lapsed and outputs the detection result to the mode deciding unit 512. More specifically, based on the sensor output value acquired via the sensor I/F circuit 206 (FIG. 12) (the output from the toner presence/absence detecting sensor 138, the density value outputted from the image density sensor 90 or the output from the waste toner fullness sensor 198), the lifetime detecting unit 508 detects that the usable time of the unit lapsed (that is, it is the replacement timing of the unit). Moreover, the lifetime detecting unit 508 may acquire the life count value 288 (FIG. 13), which is stored in the unit NVM 184, via the wireless communication unit control circuit 208 (FIG. 12) and, if the acquired life count value 288 exceeds the lifetime threshold value, may determine that the usable time lapsed.

The replacement detecting unit 510 detects the replacement of the replaceable unit and outputs the detection result to the mode deciding unit 512. More specifically, the replacement detecting unit 510 acquires the information, which is stored in the unit information region 272 (FIG. 13), via the wireless communication unit control circuit 208 (FIG. 12) and, based on a change in the acquired information, determines whether or not the replaceable unit has been replaced.

The mode deciding unit 512 decides an operation mode to be applied based on the reservation of the operation mode received by the reservation receiving unit 504 and the discrimination result in the unit discriminating unit 506 and notifies the process control circuit 216 of the decided operation mode. More specifically, the mode deciding unit 512 decides whether the reserved operation mode corresponds to a newly mounted unit (a genuine article or a non-genuine article). If it is decided that the reserved operation mode corresponds to the newly mounted unit, the mode deciding unit 512 decides the reserved operation mode as to be applied. While, if it is decided that the reserved operation mode does not correspond to the newly mounted unit, the mode deciding unit 512 decides the operation mode applied to the unit as to be applied. 'The reserved operation mode corresponds to the newly mounted unit' means that the reserved operation mode accords with an operation mode set for each unit (the genuine article or the non-genuine article). For example, for the non-genuine unit, when any one of a plurality of operation modes set for the non-genuine articles is reserved, it is determined that 'the reserved operation mode corresponds to the newly mounted unit.'

Further, the mode deciding unit 512 decides an application timing of the decided operation mode. More specifically, the mode deciding unit 512 converts the reservation information of the individual operation mode histories 270 (FIG. 13) into the formal entry at the timing detected by the lifetime detecting unit 510 that the usable time of the unit lapsed, such that the control starts according to the decided operation mode (for example, the reserved operation mode). Moreover, the timing at which the usable time of the unit lapsed does not necessarily accord with the timing at which the unit is replaced. However, in this case, since the difference of these timings is not so large, it does not matter. Further, the mode deciding unit 512 may convert the reservation information of the individual operation mode histories 270 (FIG. 13) into the formal entry at the timing at which the replacement of the unit is detected by the replacement detecting unit 510, such that the control starts according to the decided operation mode. That is, the image forming apparatus 10 automatically changes the operation mode with the lapse of the usable time of the unit or the replacement of the unit as a trigger.

When image forming signals are transmitted to the image forming apparatus 10 constructed as above, the image carrier 54 is uniformly electrified by the electrifying device 60, and light rays are emitted onto the electrified image carrier 54 from the exposure device 68 on the basis of the image signals. The light rays from the exposure device 68 expose the surface of the image carrier 54, thereby forming a latent image.

The latent image carried by the image carrier 54 is developed at a development position by the developer container unit 44. In the developer container unit 44, the developer containers 48*a* to 48*d* are respectively supplied with yellow, magenta, cyan and black toners from the toner cartridges 52*a* to 52*d*. Further, toners excessively supplied to the developer containers 48*a* to 48*d* are respectively collected into the toner cartridges 52*a* to 52*d*. Toner images developed for the respective colors by the developer containers 48*a* to 48*d* of the developer container unit 44 are superposed on the intermediate transfer body 74 to be primarily transferred thereto. At the time of the primary transfer, a waste toner remaining on the image carrier 54 is scraped by the cleaner 62 for the image carrier 54 to be collected.

On the other hand, upon receiving sheet feeding signals or the like, sheets received in the sheet feeding cassette 24 are fed by the feeding roller 26, are separated by the retard roller 28, and are respectively guided to the conveying path 34. And then the sheet is primarily stopped by the resist roller 38 and is guided between the secondary transfer roller 88 and the secondary transfer backup roller 82 at a predetermined timing. When the sheet is guided between the secondary transfer roller 88 and the secondary transfer backup roller 82, a toner image in which four colors overlap each other by the primary transfer onto the intermediate transfer body 74 is secondarily transferred on the sheet by the secondary transfer roller 88 and the secondary transfer backup roller 82. After the secondary transfer, the waste toner remaining on the intermediate transfer body 74 is scraped by the cleaner 92 for the intermediate transfer body 74 to be collected.

The sheet onto which the toner image has been transferred is guided to the fixing device 100, and the toner image on the sheet is fixed by a thermal pressure generated by the heating roller 102 and the pressing roller 104. The sheet on which the toner image has been fixed is discharged from the discharge port 36 toward the discharge section 42 by means of the discharge roller 40. The control unit 106 makes the unit NVM 184 and the main body NVM 228 store the life count value of the toner cartridge 52 or the like.

Next, a control of the image forming apparatus 10 based on data which are stored in the storage unit 204 and the unit NVM 184 will be described.

Figure 15:
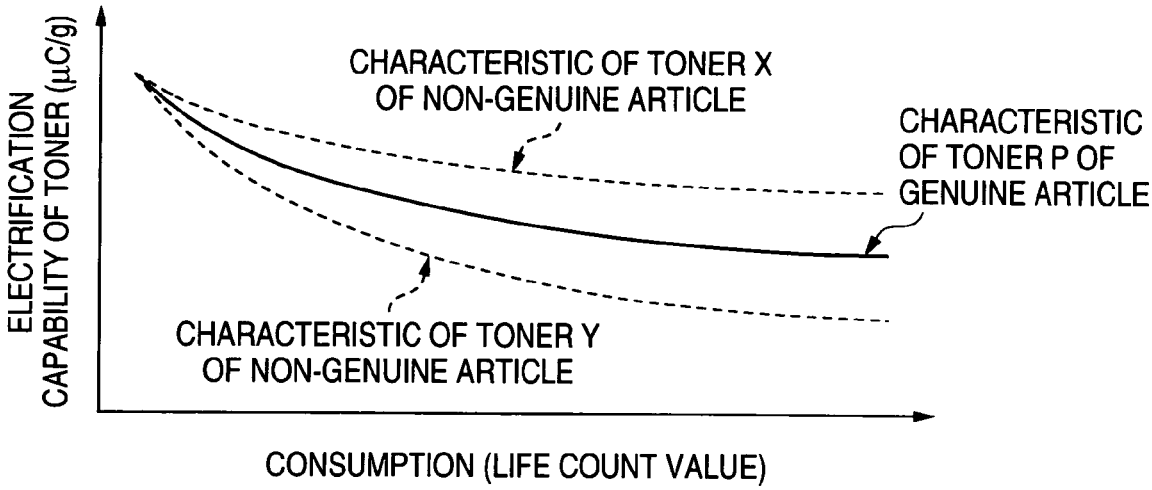
FIG. 15 is a graph showing a change in electrification capability of a developer with respect to a consumption (a life count value) stored in the main body NVM 228.

FIG. 15 is a graph showing a change in electrification capability of the developer with respect to the consumption of the developer (the life count value) which is stored in the main body NVM 228.

Figure 16:
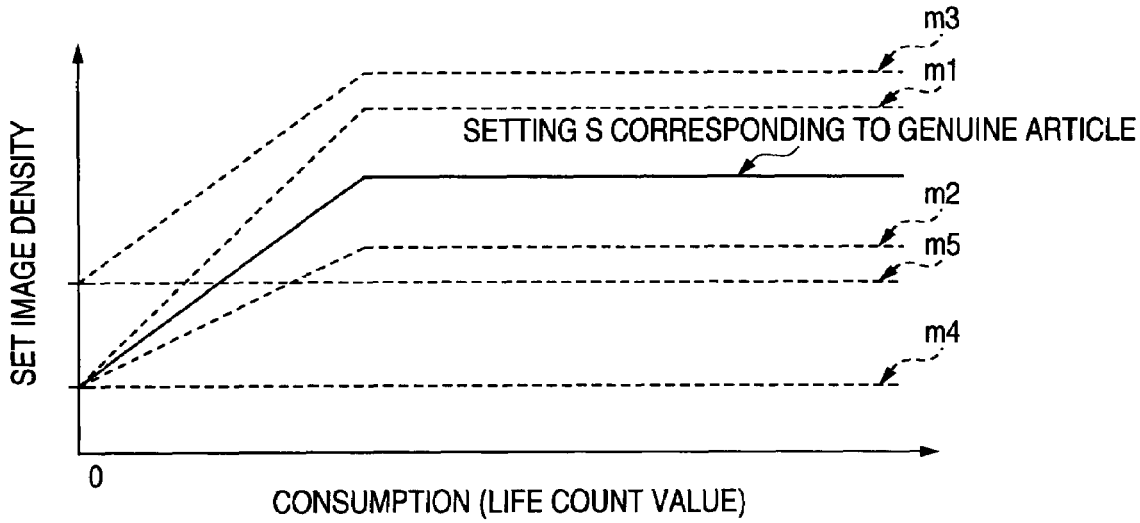
FIG. 16 is a graph showing a setting for correcting a change in electrification capability of the developer, which shows a setting of an image density with respect to the consumption of the developer.

FIG. 16 is a graph showing a setting for correcting a change in electrification capability of the developer, which shows a setting of an image density with respect to the consumption of the developer.

Figure 17A:
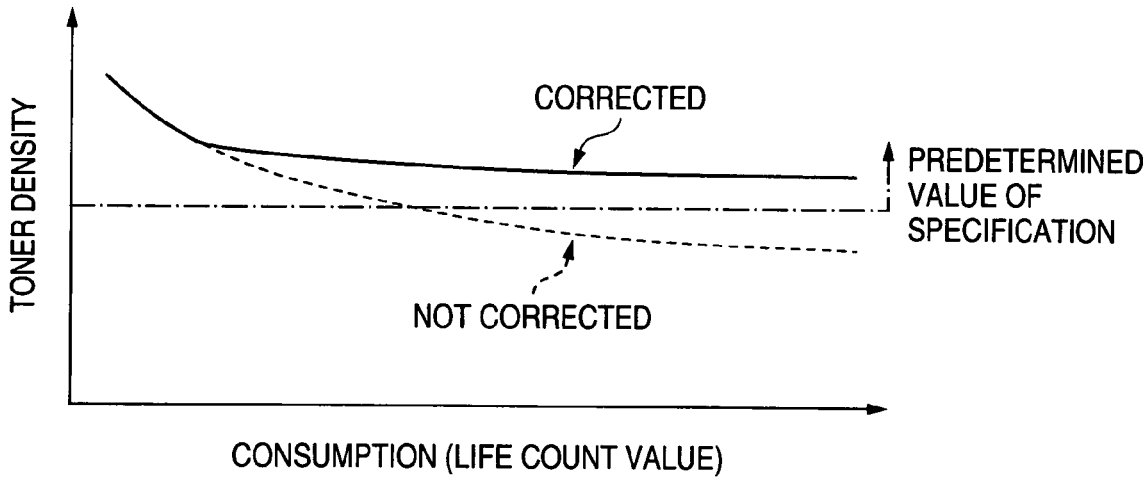
Figure 17B:
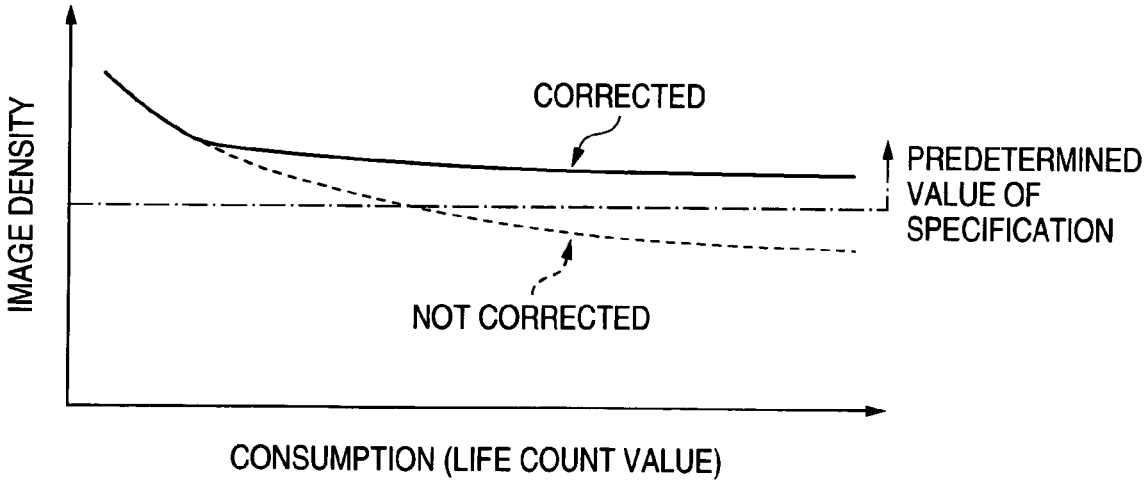

FIGS. 17A and 17B is a graph showing results corrected by the setting shown in FIG. 16, in which FIG. 17A shows a corrected toner density, and FIG. 17B shows a corrected image density.

A toner accommodated in the toner cartridge 52 is frictionally electrified so as to have predetermined polarity and electric charge quantity by a carrier in the developer container 48. When a developer is used, the electrification capability of the developer deteriorates according to the consumption of the developer, like characteristics of a genuine toner P shown in FIG. 15.

Thus, even when the image forming apparatus 10 employs a trickle development method, in order to maintain the image quality of an image formed on a sheet at a predetermined level, the setting on the density of a toner in the developer container 48 and the density of an image on the intermediate transfer body 74 should be corrected.

For example, the CPU 202 makes the image density sensor 90 detect the density of an image. At this time, if the image density is high, the CPU 202 controls the rotational drive of the first auger 118 to reduce the amount of a toner to be supplied into the developer container 48, thereby lowering the density of the toner, which lowers the density of the image. Further, if the image density is low, the CPU 202 controls the rotational drive of the first auger 118 to increase the amount of a toner to be supplied into the developer container 48, thereby raising the density of the toner, which raises the density of the image. Generally, a pattern having half-tone density is used as a pattern for detecting the above-mentioned image density.

However, when the electrification capability of a toner deteriorates, the development performance of the toner is improved and the image density is raised. Therefore, if the above-mentioned control is executed as it is, the toner density may be excessively lowered, which may lower a maximum image density.

Accordingly, even when the electrification capability of a developer deteriorates, in order for the maximum density of an image transferred onto a sheet not to be lowered, the set values for controlling the density of a toner in the developer container 48, which are stored in the toner image parameter group 248 used for controlling the toner density based on the image density detection results detected by the image density sensor 90, are corrected to increase according to the consumption of the developer. The CPU 202 makes the first auger 118 rotate according to the corrected set values (setting S corresponding to the toner P in FIG. 16) so that the toner density can be maintained so as not to be below a desired predetermined value, as shown in FIG. 17A.

As a result, as shown in FIG. 17B, the image density can be maintained so as not to be below a specified set value.

Moreover, in the present example, the setting S is associated with 'default mode A' which is an operation mode corresponding to the toner being the genuine article. If the mode S is set, the image forming apparatus 10 performs the image formation by applying the setting S.

On the other hand, in case a toner cartridge other than a genuine cartridge, which contains a toner X or a toner Y other than a genuine toner P for the image forming apparatus 10 and has substantially the same construction as that of the toner cartridge 52, is mounted, as shown in FIG. 15, it is expected the toner X or the toner Y will exhibit characteristics different from those of the genuine toner P. Thus, in order to improve the quality of an image to be formed on a sheet, corrected set values different from the setting S corresponding to the toner P are required. Accordingly, for example, in the case of any cartridge other than a genuine cartridge, which contains the toner X or the toner Y, correction is made to the consumption of a developer obtained by combining conditions to be changed, such as increasing or decreasing the degree of a change (gradient) in a set value of the toner density (m1 or m2 in FIG. 16); increasing or decreasing a limit value (m1 or m2); varying an initial value (consumption=0) (m3); no making a change in a set value according to the consumption (m4); and no making a change in a set value according to the consumption, for example, by varying an initial value (m5). This change is performed by allowing a user to select an operation mode other than that corresponding to the genuine toner via the UI device 18.

Moreover, in the present example, the setting m1 is associated with 'mode A' which is an operation mode corresponding to the toner being the non-genuine article. If the mode A is set, the image forming apparatus 10 performs the image formation by applying the setting m1. Similarly, the setting m2 is associated with 'mode B' which is an operation mode corresponding to the non-genuine article, the setting m3 is associated with 'mode C' which is an operation mode corresponding to the non-genuine article, the setting m4 is associated with 'mode D' which is an operation mode corresponding to the non-genuine article, and the setting m5 is associated with 'mode E' which is an operation mode corresponding to the non-genuine article. That is, for the non-genuine articles (the toner cartridge and the like), the image forming apparatus 10 has in advance a plurality of operation modes, of which correction quantities are different from each other in the image formation process. Further, the operation mode corresponding to the non-genuine article is preferably a mode (a save mode) in which a disorder (a stain in the apparatus due to the toner or the like) in the image forming apparatus 10 is difficult to be caused, as compared to 'a default mode S' set under the well-known performance of the genuine article.

Further, on the basis of the data stored in the storage unit 204 and the unit NVM 184, the image forming apparatus 10 controls display or the like by the UI device 18. For example, if the toner cartridge 52 is the genuine article, the residual quantity of the toner is displayed on the UI device 18, whereas if the toner cartridge 52 is the non-genuine article, the consumption of the toner is displayed on the UI device 18. This is because, if the toner cartridge 52 is the non-genuine article, the quantity of the toner is unknown, so the residual quantity of the toner can not be calculated.

A method of controlling the image forming apparatus 10 based on data stored in the storage unit 204 and the unit NVM 184 will be described.

Figure 18:
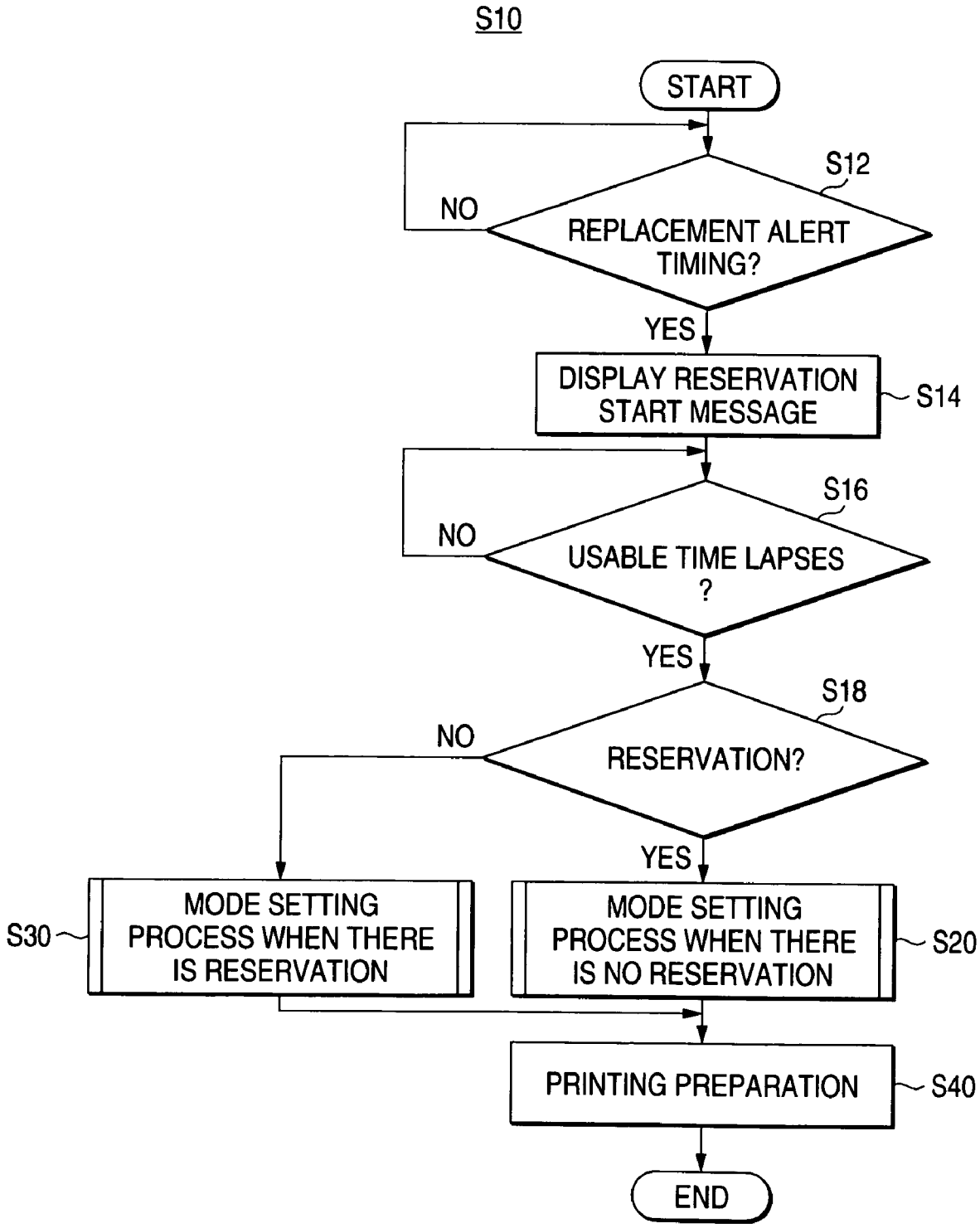
FIG. 18 is a flowchart (S10) showing operations of the image forming apparatus 10 related to the replacement of the unit.

FIG. 18 is a flowchart (S10) showing an operation of the image forming apparatus 10 related to the replacement of the unit. Moreover, in the present flowchart, the toner cartridge 52 will be described as a specified example of the replaceable unit.

As shown in FIG. 18, in the step 12 (S12), the CPU 202 (the message output unit 502) acquires the toner presence/absence information via the sensor I/F circuit 206 (FIG. 12). Here, if it is detected that the toner is absent, the process progresses to the process of S14. In other cases, a monitoring of the toner presence/absence information is continued. That is, based on the toner presence/absence information, the CPU 202 determines whether or not it is the replacement alert timing at which it should be notified that the replacement timing of the toner cartridge 52 is close in time. Moreover, even when it is detected by the toner presence/absence detecting sensor 138 that the toner is absent, the toner remains in a vicinity of the toner feeding port 136 (FIG. 5), such that the printing can be continuously performed. As such, the image forming apparatus 10 determines that it is the replacement alert timing, based on the toner presence/absence information. Thus, even when the toner cartridge 52 of the non-genuine article (that is, the toner cartridge having the unknown lifetime) is mounted, it is possible to alert that the replacement timing of the toner cartridge 52 is close in time, prior to the printing impossibility.

In the step 14 (S14), the CPU 202 (the message output unit 502) instructs the UI device 18 to display the reservation start message via the UI control circuit 212 (FIG. 12).

Figure 23A:
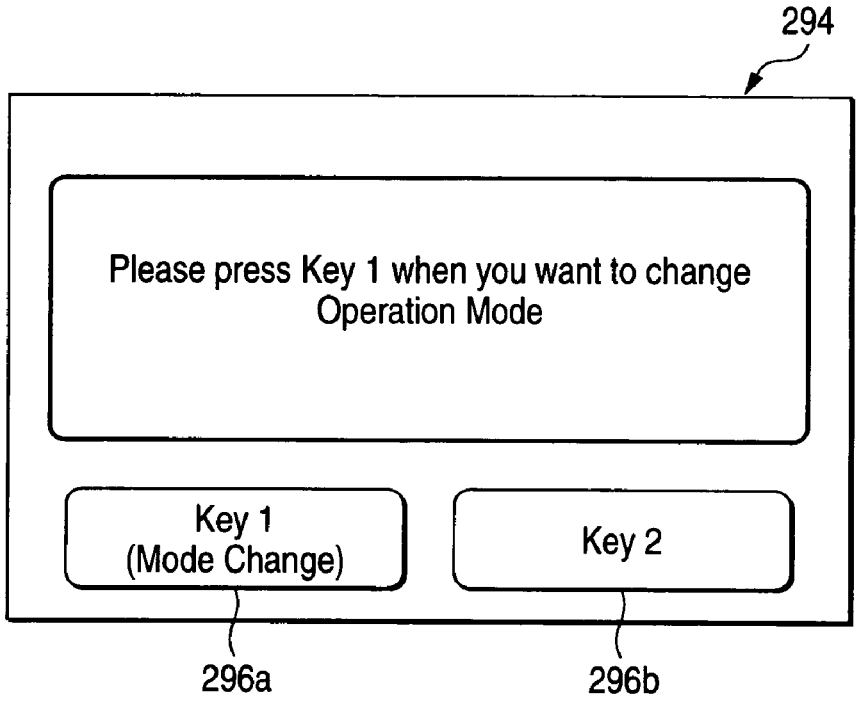
Figure 23B:
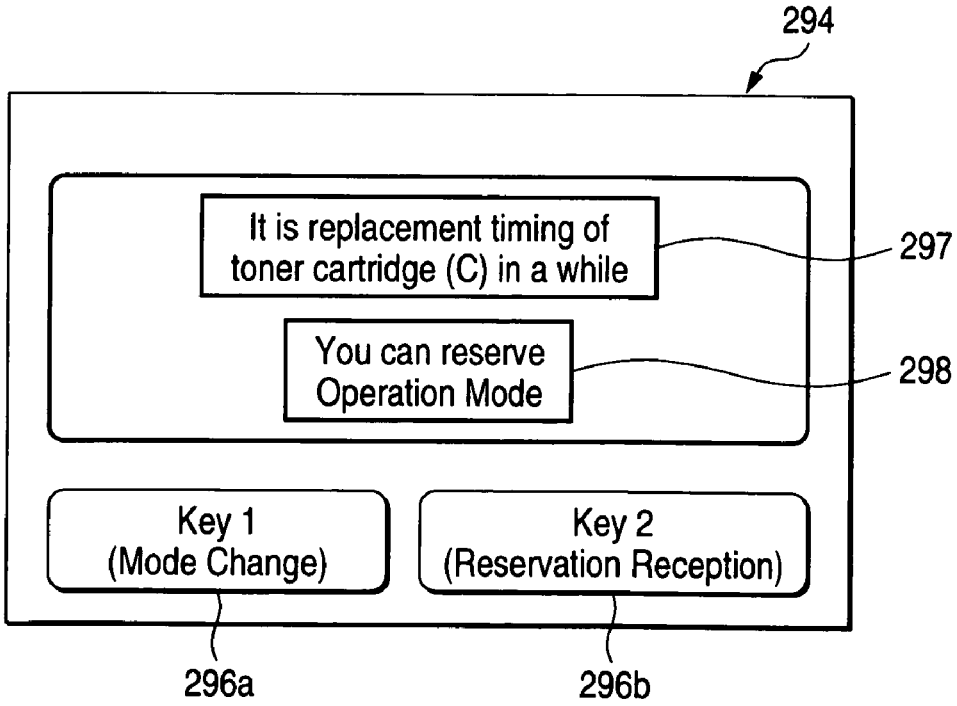
Figure 24:
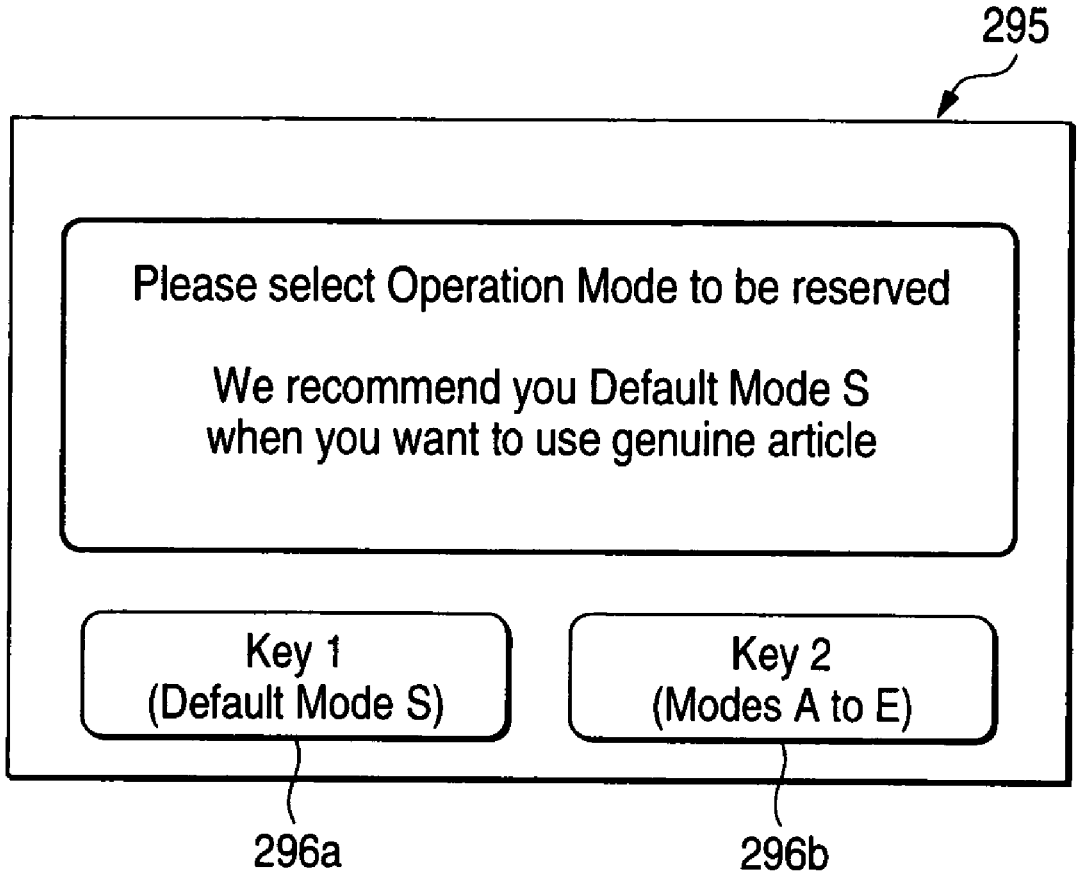
FIG. 24 is a diagram exemplarily showing an operation mode reservation screen which receives the reservation of the operation mode.

The UI device 18 displays a replacement alert display 297 of the toner cartridge and the reservation start message 298 on a screen 294 shown in FIG. 23B, according to the instruction from the CPU 202. On the screen 294, in addition to the replacement alert display 297 and the reservation start message 298, a key button 296*a* for changing into an operation mode selection screen 299 (described later in FIGS. 25A and 25B) and a key button 296*b* for changing into an operation mode reservation screen 295 (described later in FIG. 24) are displayed.

Further, the UI device 18 receives the reservation of the operation mode from the user until the usable time of the toner cartridge 52 lapses (that is, until the process progresses to S18). Specifically, if the user presses the key button 296*b* shown in FIG. 23B, the UI device 18 detects the operation of the user and displays the operation mode reservation screen 295 shown in FIG. 24. On the operation mode reservation screen 295, a key button 296*a* for selecting 'default mode S' and a key button 296*b* for selecting 'modes A to E' are displayed. Moreover, the mode A to the mode E can be selected by consecutively pressing the key button 296*b*.

The user operates the key button 296*a* or the key button 296*b* on the operation mode reservation screen 295 (FIG. 24) and selects an operation mode to be reserved ('default mode S', 'mode A', 'mode B' or the like). The CPU 202 (the reservation receiving unit 504) detects the selection operation of the user via the UI control circuit 212 (FIG. 12) and receives the selected operation mode as the reserved operation mode.

In the step 16 (S16), the CPU 202 (the lifetime detecting unit 508) acquires the density value from the image density sensor 90 via the sensor I/F circuit 206 (FIG. 12) and compares the acquired density value to a target density value to determines whether or not the usable time (lifetime) of the toner cartridge lapsed. If the usable time lapsed, the printing operation is forcibly stopped and then the process progresses to S18. In other cases, a monitoring of the usable time of the toner cartridge is continuously performed. Moreover, when the genuine toner cartridge 52 is mounted, the CPU 202 may compare the lifetime threshold value 240 of the toner cartridge and the life count value 264 of the toner cartridge and determine whether or not the usable time of the toner cartridge lapsed.

In the step 18 (S18), the CPU 202 (the mode deciding unit 512) determines via the UI device 18 whether or not a reservation is received. If there is no reservation, the process progresses to S20, while if there is a reservation, the process progresses to S30.

In the step 20 (S20), the CPU 202 receives the selection operation of the user and sets an operation mode after the replacement of the toner cartridge.

Further, in the step 30 (S30), the CPU 202 sets an operation mode after the replacement of the toner cartridge, according to the reservation of the operation mode and a newly mounted toner cartridge 52.

In the step 40 (S40), the CPU 202 performs printing preparation fit to an operation mode set, and then the process is ended. Moreover, in the printing preparation in S40, for example, whether or not the mounted toner cartridge 52 is the genuine article may be displayed on the UI device 18.

Next, an operation mode setting process (S20) when there is no reservation will be described in detail.

Figure 19:
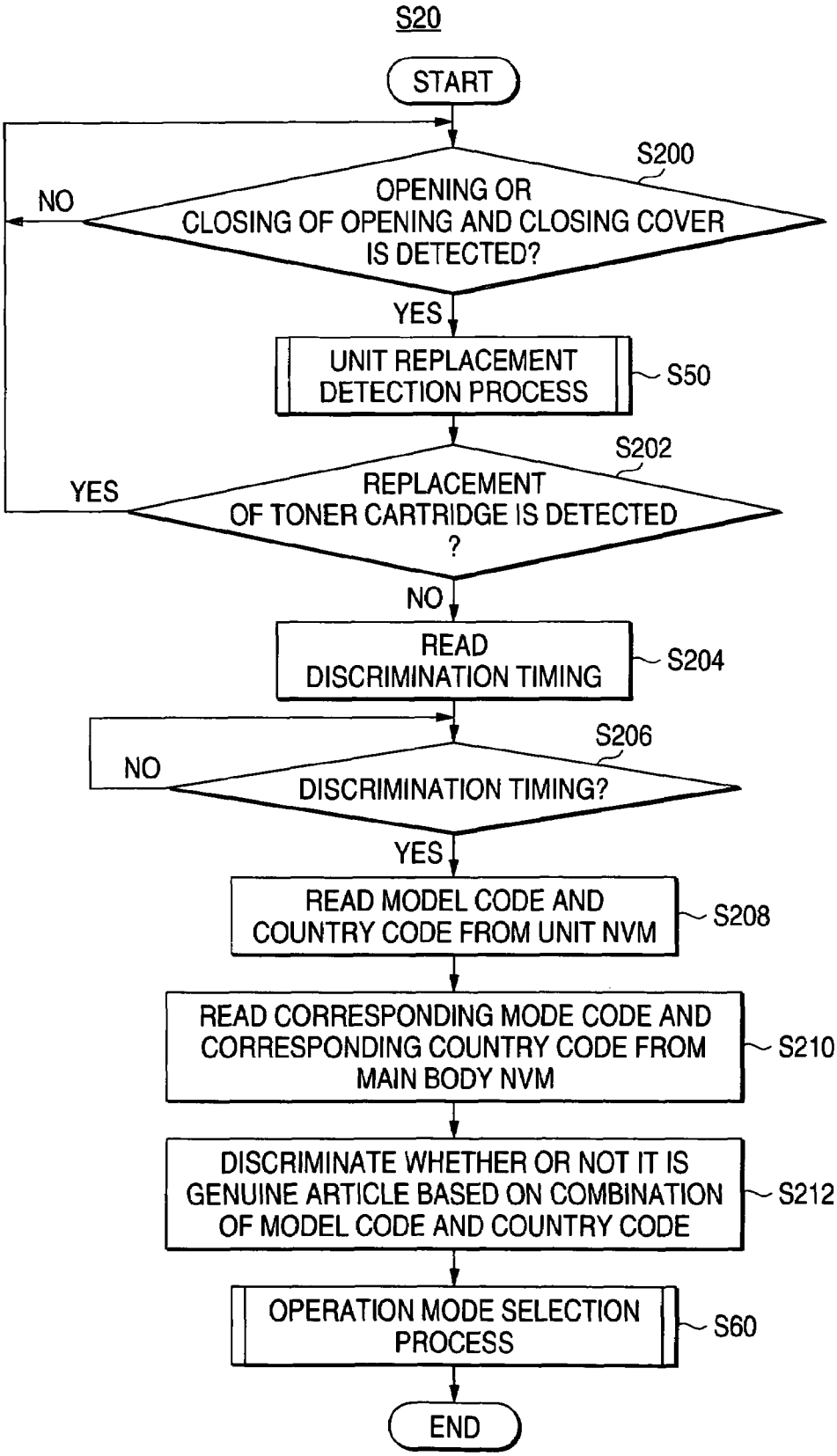
FIG. 19 is a flowchart (S20) showing an operation mode setting process in the case in which there is no reservation.

FIG. 19 is a flowchart (S20) showing the operation mode setting process when there is no reservation.

Figure 20:
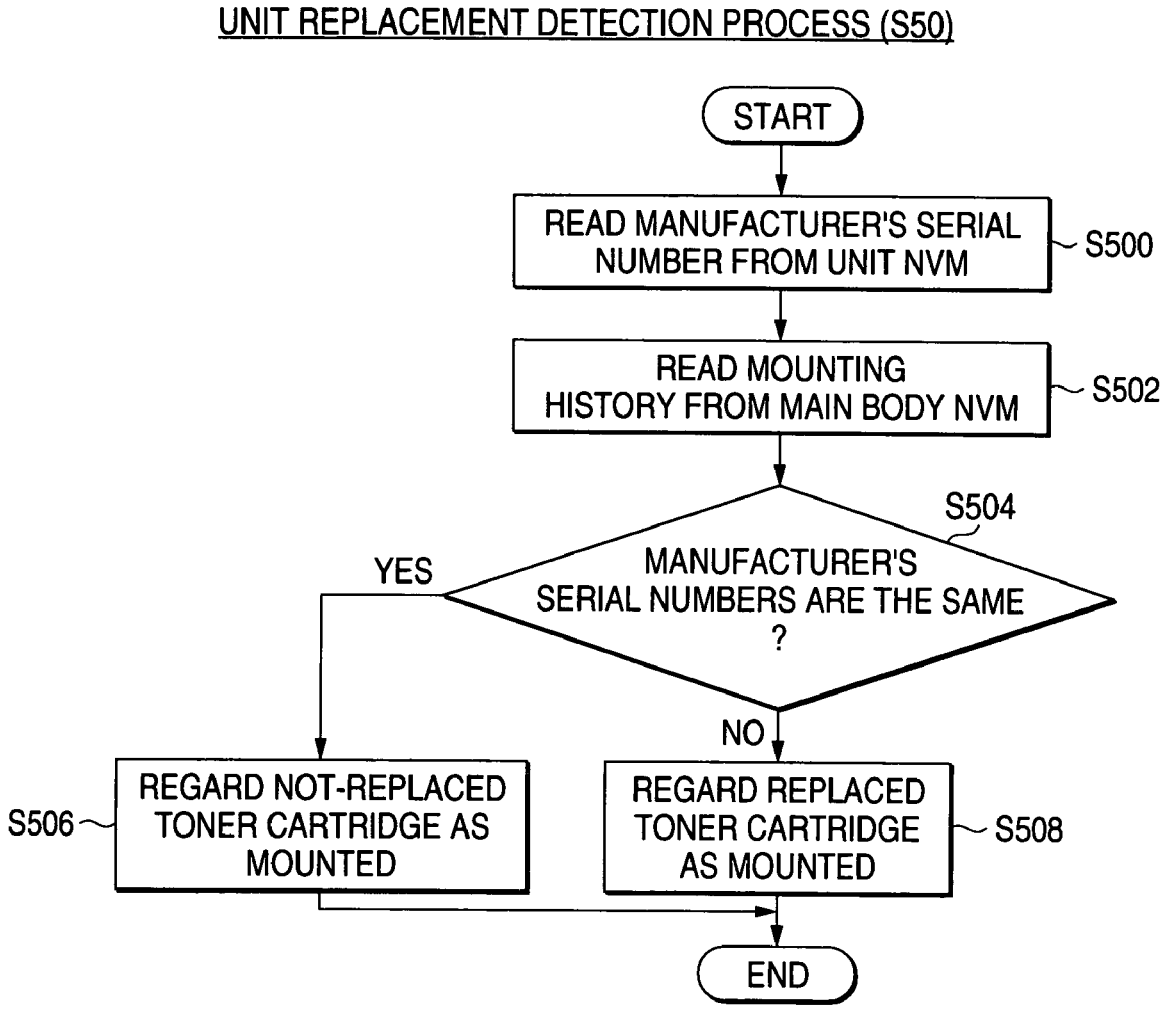
FIG. 20 is a flowchart (S50) showing a unit replacement detection process of detecting whether or not a toner cartridge has been replaced.

FIG. 20 is a flowchart (S50) showing a unit replacement detection process of detecting whether or not a unit has been replaced.

Figure 21:
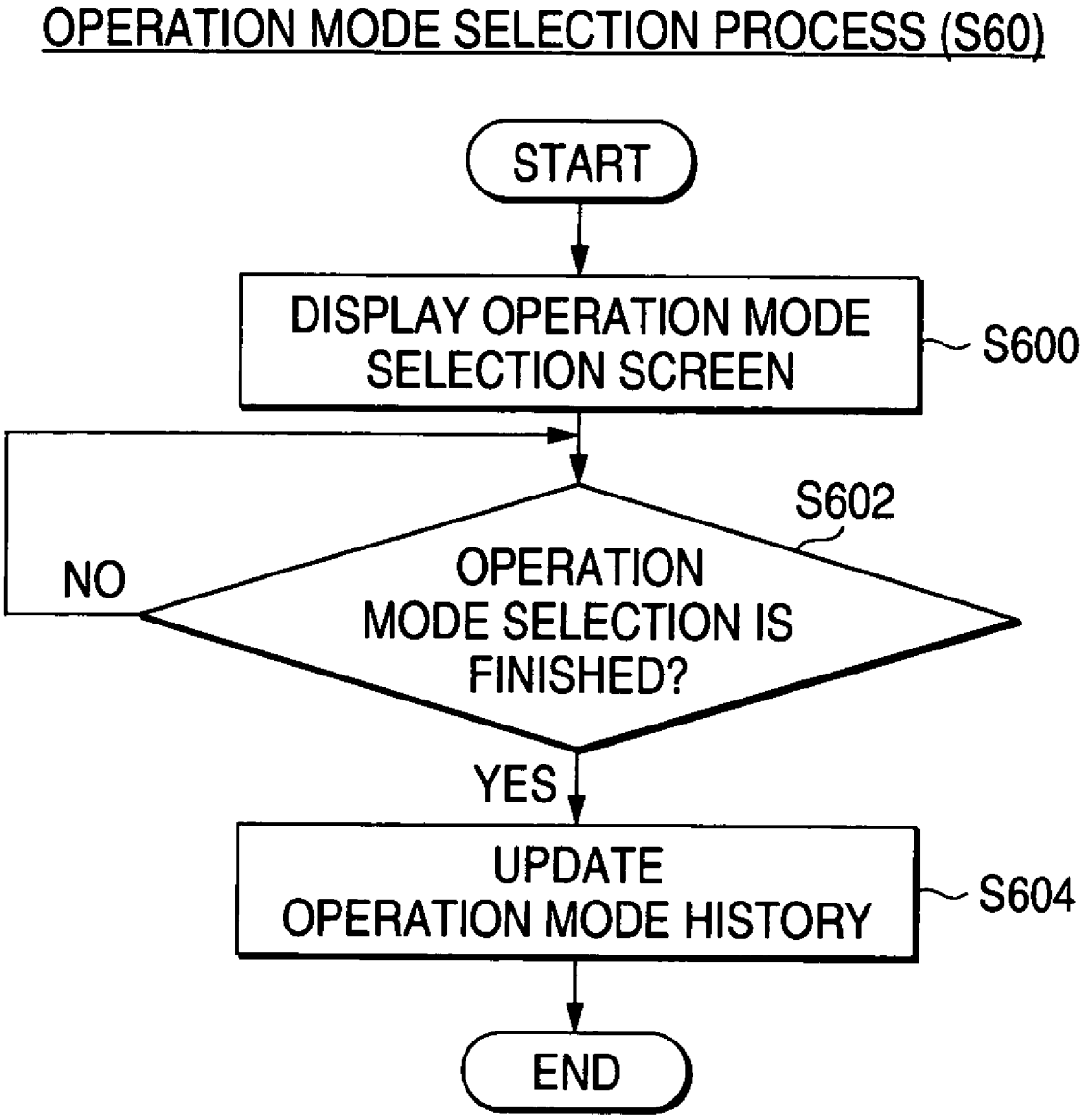
FIG. 21 is a flowchart (S60) showing an operation mode selection process to be performed by the image forming apparatus such that a user can select an operation mode.

FIG. 21 is a flowchart (S60) showing an operation mode selection process to be performed by the image forming apparatus 10 such that a user can select an operation mode.

In the step 200 (S200), the CPU 202 determines whether or not the opening and closing detecting sensor 19 detects opening or closing of the opening and closing cover 16. If the CPU 202 determines that the opening or closing of the opening and closing cover 16 is detected, the process progresses to S50. In other cases, the process returns to S200. That is, when the opening and closing cover 16 is opened or closed, the toner cartridge 52 is likely to have been replaced, and thus the unit replacement detection process is performed.

In the step 500 (S500 in FIG. 20), the CPU 202 reads the manufacture's serial number 280 from the unit NVM 184.

In the step 502 (S502), the CPU 202 reads the manufacturer's serial number 280 of the latest mounted toner cartridge, which is included in the mounting history 262 of each unit of the main body NVM 228.

In the step 504 (S504), the CPU 202 determines whether or not the manufacturer's serial number of the latest mounted toner cartridge and the manufacturer's serial number 280 acquired from the unit NVM 184 are the same. When the manufacturer's serial number of the latest mounted toner cartridge and the manufacturer's serial number 280 acquired from the unit NVM 184 are the same, the process progresses to S506. In other cases, the process progresses to S508.

In the step 506 (S506), the CPU 202 regards the toner cartridge 52 not replaced as mounted again (not replaced).

In the step 508 (S508) the CPU 202 regards the toner cartridge 52 replaced as mounted (replacement detected).

In the step 202 (S202 in FIG. 19), when the CPU 202 regards that the replacement of the toner cartridge 52 is detected, the process progresses to S204. In other cases, the process returns to S200.

In the step 204 (S204), the CPU 202 reads the determination timing set value 252 from the program ROM 224.

Moreover, the determination timing set value 252 may be zero (0).

In the step 206 (S206), the CPU 202 determines with a timer (not shown) whether or not it is the determination timing. At the determination timing, it is determined whether or not the mounted toner cartridge 52 is the genuine article. When it is the determination timing at which it is determined whether the toner cartridge 52 is the non-genuine article, the process progresses to S208. In other cases, the CPU 202 waits until the determination timing comes.

In the step 208 (S208), the CPU 202 reads the model code 276 and the country code 278 from the unit NVM 184.

In the step 210 (S210), the CPU 202 reads the corresponding model code 258 and the corresponding country code 260 from the main body NVM 228.

In the step 212 (S212), the CPU 202 compares the model code 276 and the country code 178 to the corresponding model code 258 and the corresponding country code 260, respectively, and determines whether or not the replaced toner cartridge 52 is the genuine article.

The CPU 202 updates the mounting history 262 of each unit of the main body NVM 228 according to data read from the toner cartridge 52 which is currently mounted. The process progresses to S60.

Figure 25A:
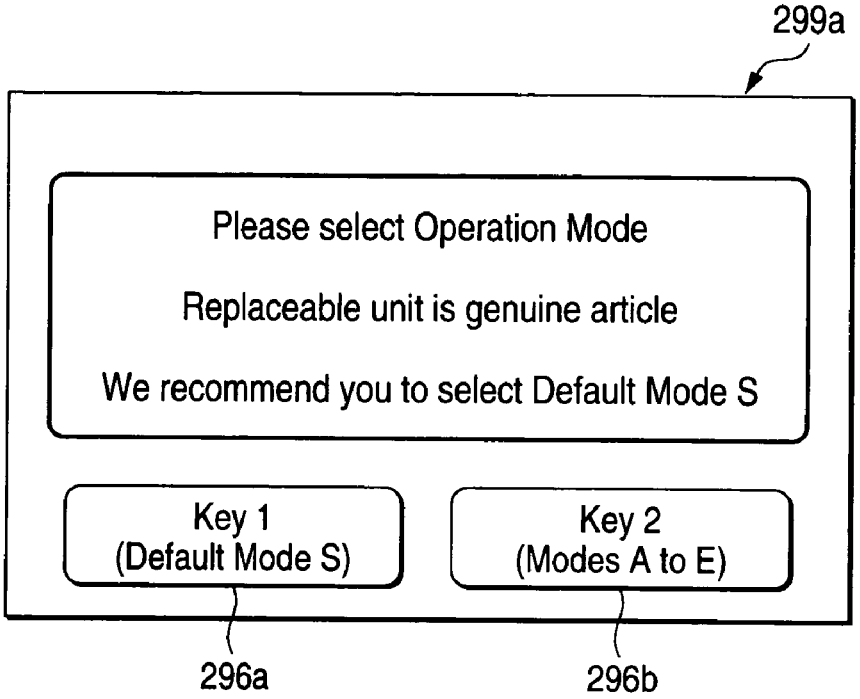
Figure 25B:
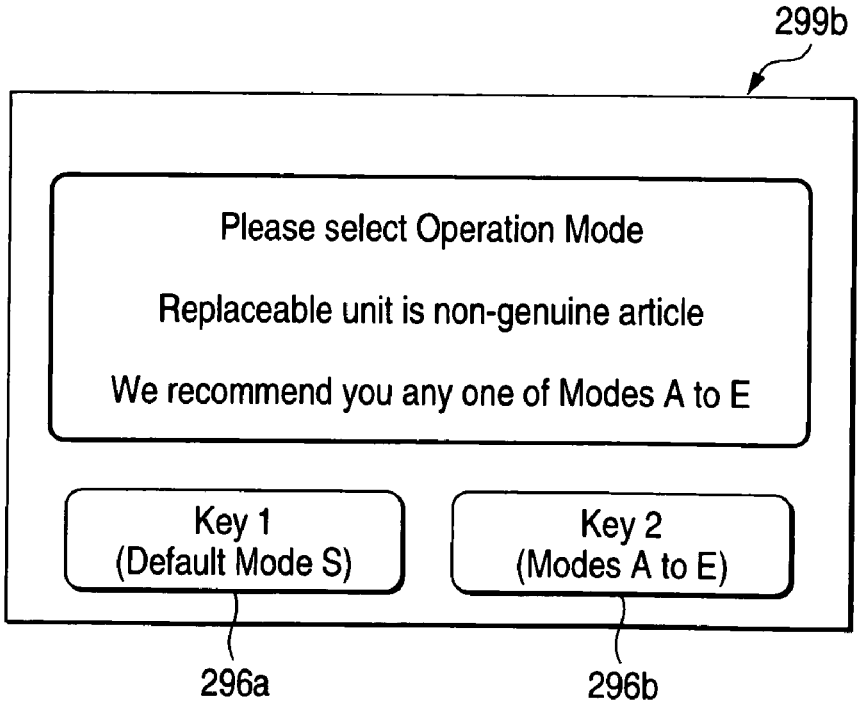

In the step 600 (S600), as exemplarily shown in FIGS. 25A and 25B, the UI device 18 displays the operation mode selection screen 299 according to the mounted toner cartridge 52 (the genuine article or the non-genuine article). Specifically, when the mounted toner cartridge 52 is the genuine article, the UI device 18 displays an operation mode selection screen 299*a* shown in FIG. 25A. Further, when the mounted toner cartridge 52 is the non-genuine article, the UI device 18 displays an operation mode selection screen 299*b* shown in FIG. 25B. On the operation mode selection screen

299*a* corresponding to the genuine article, a key button 296*a* for selecting a default mode S (an operation mode corresponding to the genuine article), a key button 296*b* for selecting other operation modes (operation modes corresponding to the non-genuine articles), and messages purporting that the mounted toner cartridge is the genuine article and that it is preferable to select the default mode S are displayed. On the operation mode selection screen 299*b* corresponding to the non-genuine article, a key button 296*a* and a key button 296*b* similar to those described above, and messages purporting that the mounted toner cartridge is the non-genuine article and that it is preferable to select other operation modes (the mode A to the mode E) are displayed. Moreover, the mode A to the mode E can be selected by consecutively pressing the key button 296*b*.

In the step 602 (S602), the CPU 202 determines whether or not an input which selects the key button 296*a* or the key button 296*b* displayed on the operation mode selection screen 299*a* (or the operation mode selection screen 299*b*) is finished. If the input which selects any one of the key button 296*a* and the key button 296*b* is finished, the process progresses to S604. If there is no the input which specifies any one of the operation modes, the image forming apparatus 10 waits until the user selects an operation mode.

In the step 604 (S604), the CPU 202 updates (overwrites) each operation mode history 270 of the main body NVM 228 to the operation mode selected in the S602. That is, the CPU 202 updates each operation mode history 270 of the main body NVM 228 according to the input of the user and sets an operation mode selected by the user.

Next, an operation mode setting process (S30) when there is a reservation will be described in detail.

Figure 22:
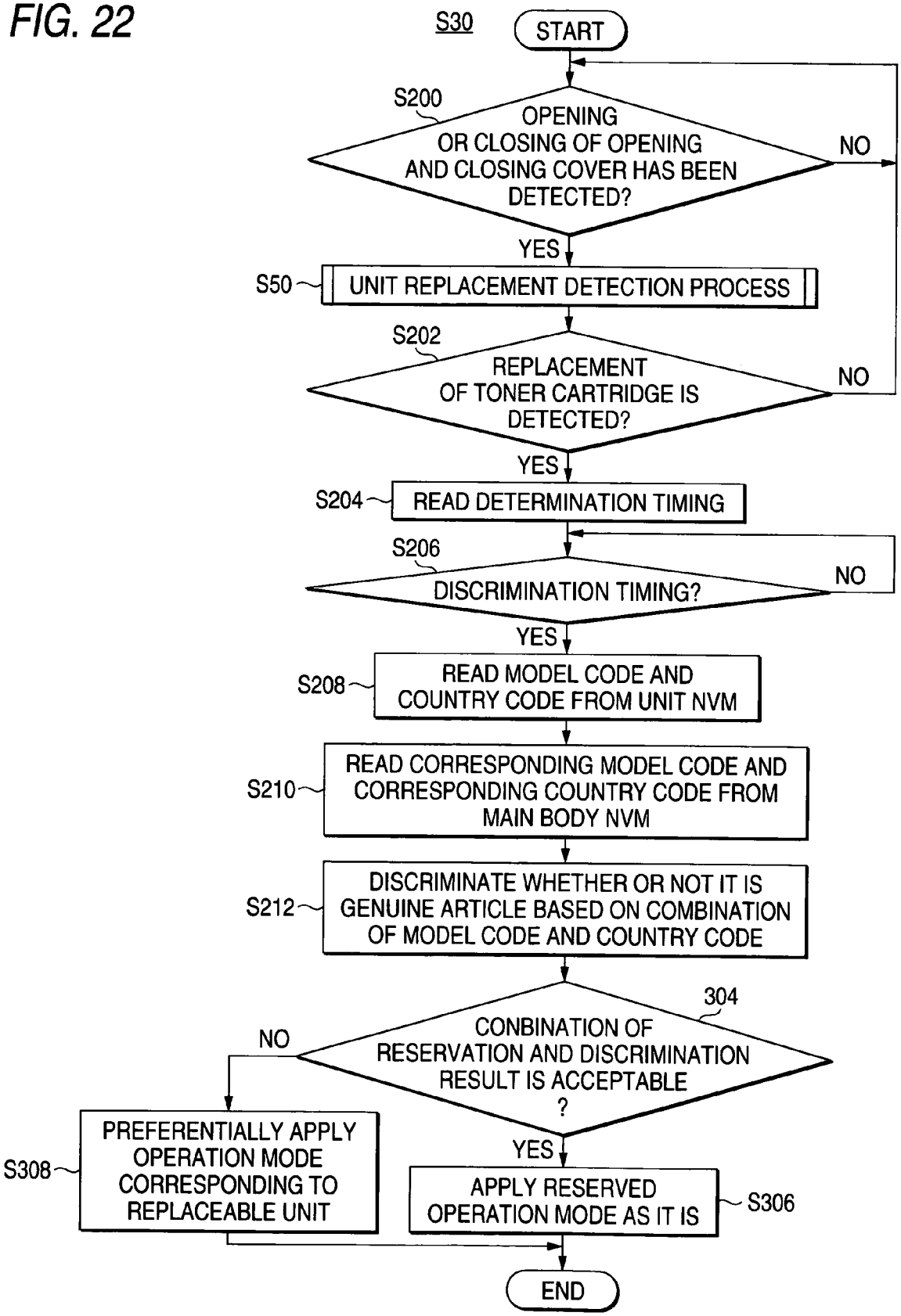
FIG. 22 is a flowchart (S30) showing an operation mode setting process in the case in which there is a reservation.

FIG. 22 is a flowchart (S30) showing an operation mode setting process when there is a reservation. Moreover, in the process shown in FIG. 22, the substantially same steps as those in the process shown in FIG. 19 are given the same reference numerals.

As shown in FIG. 22, from S200 to S206, the CPU 202 detects the replacement of the toner cartridge 52 and decides the discrimination timing at which the discrimination process of the newly mounted toner cartridge 52 is performed.

In S208, the CPU 202 reads the model code 276 and the country code 278 of the toner cartridge 52 from the unit NVM 184 and further, in S210, reads the corresponding model code 258 and the corresponding country code 260 from the main body NVM 228, at the decided discrimination timing.

In S212, the CPU 202 (the unit discriminating unit 506) compares the model code 276 and the country code 278 read to the corresponding model code 258 and the corresponding country code 260 read, respectively, and discriminates whether the replaced toner cartridge 52 is the genuine article.

In the step 304 (S304), the CPU 202 (the mode deciding unit 512) determines whether or not a combination of the reserved operation mode and the newly mounted unit (the genuine article or the non-genuine article) is acceptable. If the combination is acceptable, the process progresses to S306. If the combination is not acceptable, the process progresses to S308. Specifically, a combination of 'the default mode S' and the genuine article and combinations of 'the mode A' to 'the mode E' and the non-genuine article are determined as be acceptable, while other combinations are determined as be not acceptable.

In the step 306 (S306), the CPU 202 (the mode deciding unit 512) updates each operation mode history 270 of the main body NVM 228 according to the received reservation and sets the operation mode reserved by the user.

In the step 308 (S308), the CPU 202 (the mode deciding unit 512) updates each operation mode history 270 of the main body NVM 228 according to the newly mounted unit (the genuine article or the non-genuine article) and sets any one of the operation modes corresponding to the mounted unit. Moreover, when the combination of the reserved operation mode and the newly mounted unit is not acceptable and the operation mode corresponding to the unit is preferentially applied (S308), for example, a purport that an operation mode is set according to whether or not the mounted toner cartridge 52 is the genuine article or the discrimination result of the toner cartridge 52 preferentially may be displayed on the UI device 18.

As described above, the image forming apparatus 10 according to the present embodiment can receive the reservation of the operation mode before the toner cartridge 52 is empty and the printing operation is forcibly stopped. Thus, switching of an operation mode following a replacement of a toner cartridge 52 can be smoothly performed. That is, the image forming apparatus 10 can simplify the control for performing the control regarding the forcible stop of the printing operation and the control which receives the selection of the operation mode at the different timing. Further, if a supervisor previously performs the reservation of the operation mode, a general user can replace the toner cartridge 52 without considering the switching of the operation mode. Further, the management of consumables in the respective image forming apparatuses 10 becomes easy.

In particular, when operation modes suitable for the respective toner cartridges 52 which are the non-genuine articles are prepared, preferably, the qualified supervisor can previously select the operation modes suitable for the respective toner cartridges 52.

Further, the image forming apparatus 10 determines the combination of the reserved operation mode and the newly mounted toner cartridge 52, such that a disorder caused by a mismatch of the toner cartridge 52 and the operation mode can be previously prevented.

Further, there are many cases in which the user places an order for the toner cartridge 52 to be newly mounted after the replacement alert display 297 of the toner cartridge is displayed. Thus, the reservation start message 298 of the operation mode and the replacement alert display 297 of the toner cartridge can be displayed almost simultaneously. Therefore, it becomes easy to associate the kind of the toner cartridge 52 (the genuine article or the non-genuine article) with the operation mode to be reserved.

Moreover, in the above-mentioned flowcharts (from FIG. 18 to FIG. 22), the setting of the operation mode following the replacement of the toner cartridge 52 is mainly described, but the setting of the operation mode can be performed at a timing regardless of the replacement of the toner cartridge 52. That is, the screen 294 shown in FIG. 23A can be displayed at any time. For example, if the user touches the key button 296*a* of the screen 294 shown in FIG. 23A, which is displayed on the UI device 18, the operation mode selection screen 299 shown in FIGS. 25A and 25B can be displayed.

In a time other than the time of receiving the reservation, if any one of the operation modes on the operation mode selection screen 299 is selected, the image forming apparatus 10 applies the selected operation mode immediately.

Further, in the above-mentioned flowchart (FIG. 22), the image forming apparatus 10 performs the progress to the reserved operation mode with the replacement detection of the toner cartridge 52 (S202) as the trigger. Alternatively, however, the progress to the reserved operation mode may be performed with the lapse of the usable time of the toner cartridge 52 as the trigger. In this case, the image forming apparatus 10 performs the progress to the reserved operation mode when the life count value 264 of the toner cartridge 52 arrives at the lifetime threshold value 240, without determining whether the combination of the reserved operation mode and the newly mounted toner cartridge 52 is acceptable.

Further, the user can perform the reservation of the operation mode with the host apparatus 2. That is, in S14 of FIG. 18, the host apparatus 2 displays the screen 294 shown in FIG. 23B (on which the reservation start message 298 and the replacement alert display 297 of the toner cartridge are displayed) in a popup manner according to the request from the image forming apparatus 10. And then, if the key button 296*b* is clicked on the screen 294, the operation mode reservation screen 295 (FIG. 24) which receives the reservation of the operation mode is displayed. If any one of the operation modes is selected on the operation mode reservation screen 295, the host apparatus 2 notifies the image forming apparatus 10 of the selected operation mode as the reserved operation mode. Moreover, the image forming apparatus 10 may transmit the reservation start message 298 or the like to the host apparatus 2 by an electronic mail, such that the screen 294 shown in FIG. 23B (on which the reservation start message 298 and the replacement alert display 297 of the toner cartridge are displayed) may be displayed on the host apparatus 2.

As such, the image forming apparatus 2 displays the reservation start message, which urges the reservation of the operation mode, on the host apparatus 2 and then receives the reservation of the operation mode via the host apparatus 2. Accordingly, the supervisor can performs the reservation of the operation mode even if he does not go to near the image forming apparatus 10 on purpose.

Second Embodiment

An image forming apparatus, an image forming system, and a method of controlling the image forming apparatus of the second embodiment includes configurations of the first embodiment that are explained by FIGS. 1 to 25. Therefore, in this embodiment, explanations of the overlapped configurations are omitted.

Figure 26:
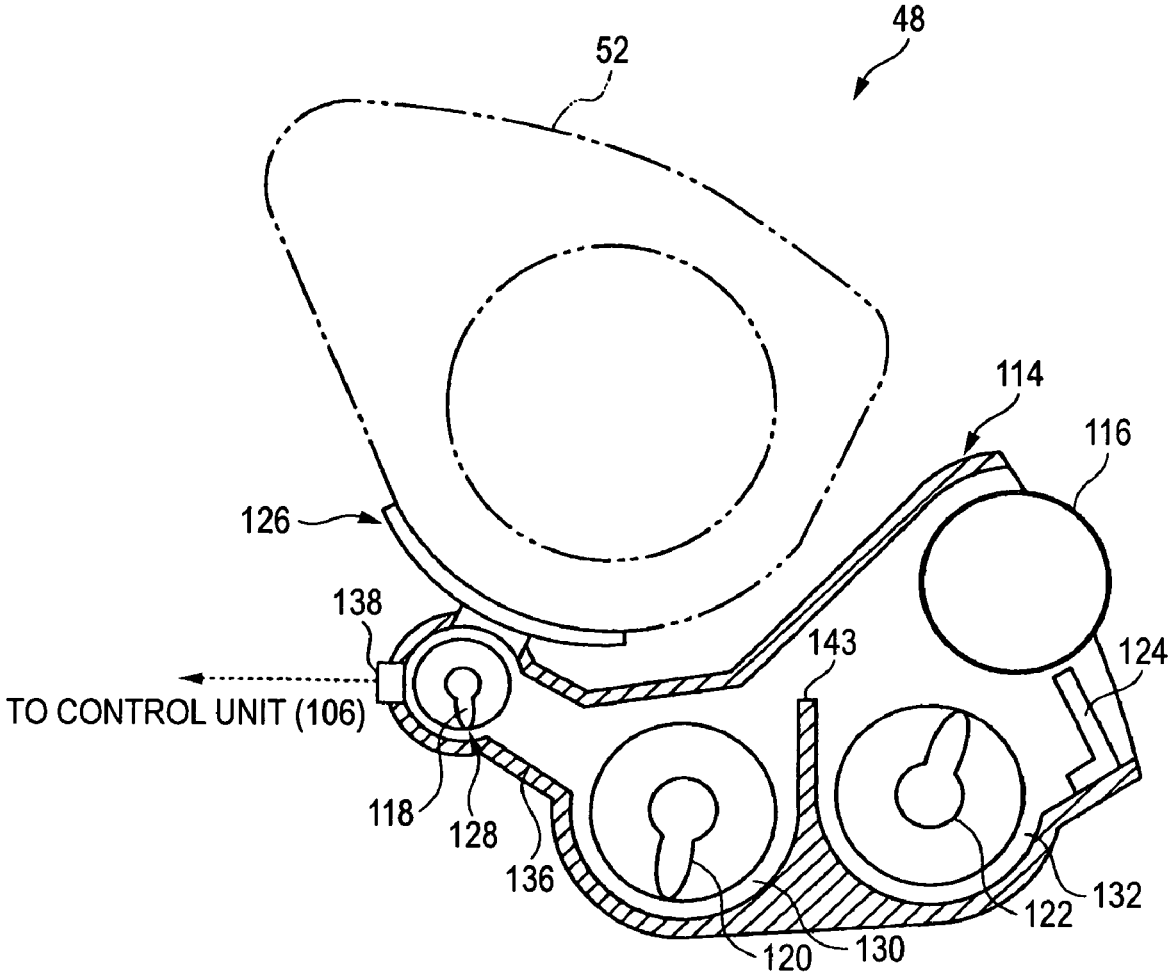
FIG. 26 is a schematic view showing a cross-section of the developer container of the image forming apparatus according to the embodiment of the present invention.

FIG. 26 is a schematic view illustrating a cross-section of the developer container of the image forming apparatus according to the embodiment of this embodiment.

On the basis of the data stored in the storage unit 204 and the unit NVM 184, the image forming apparatus 10 controls display by the UI device 18, or the like. For example, if the toner cartridge 52 is genuine, the CPU 202 controls the UI device 18 to display the residual quantity of the toner, whereas if the toner cartridge 52 is not genuine, the CPU 202 controls the UI device 18 to display the consumption of the toner. This is because, if the toner cartridge 52 is not genuine, the quantity of the toner is unknown, so that the residual quantity of the toner cannot be calculated.

Next, a method of controlling the image forming apparatus 10 based on the data stored in the storage unit 204 and the unit NVM 184 will now be described.

Figure 27:
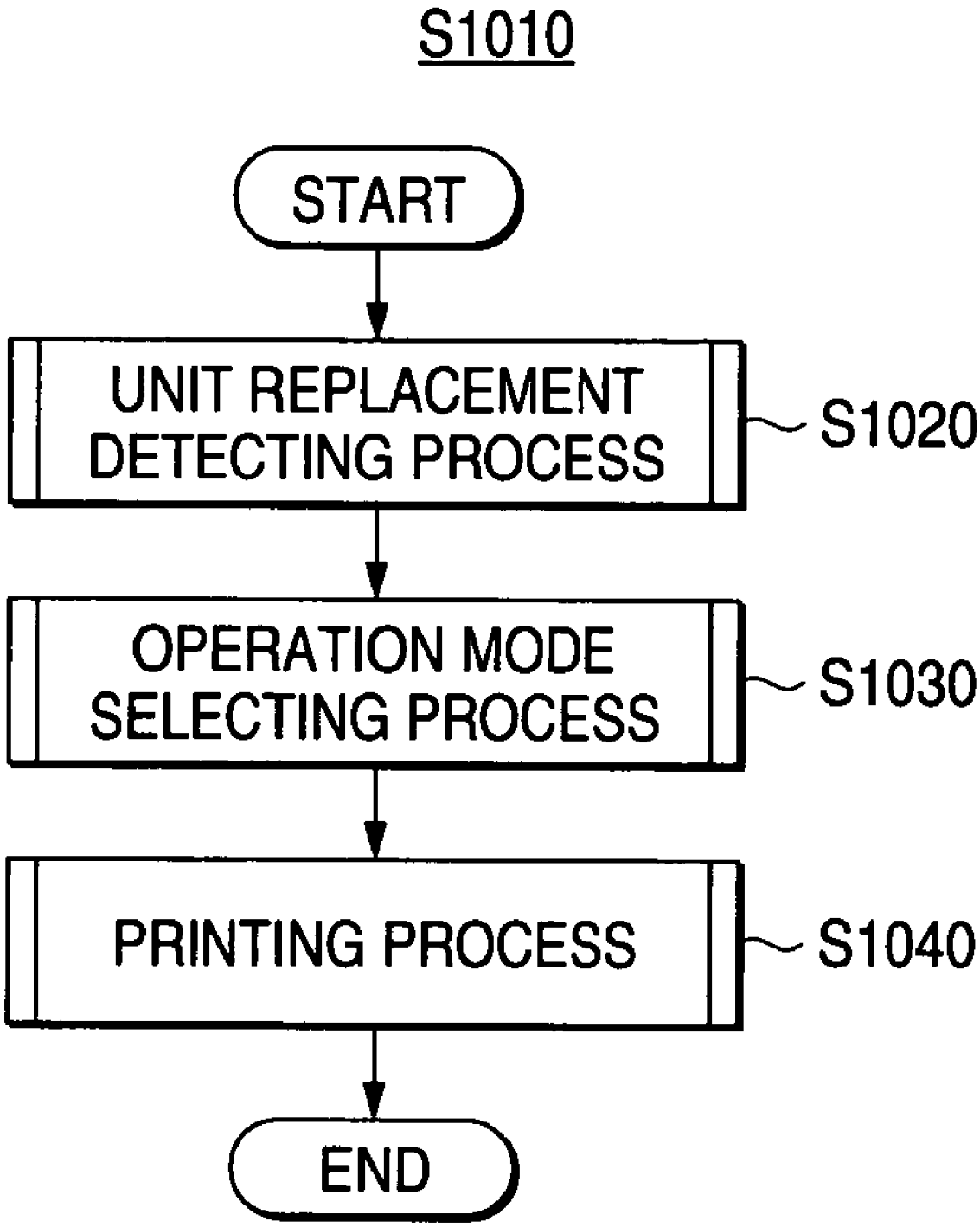
FIG. 27 is a flowchart showing a process (S1010) of the overall image forming apparatus.

FIG. 27 is a flowchart showing a process (S1010) of the overall image forming apparatus.

Figure 28:
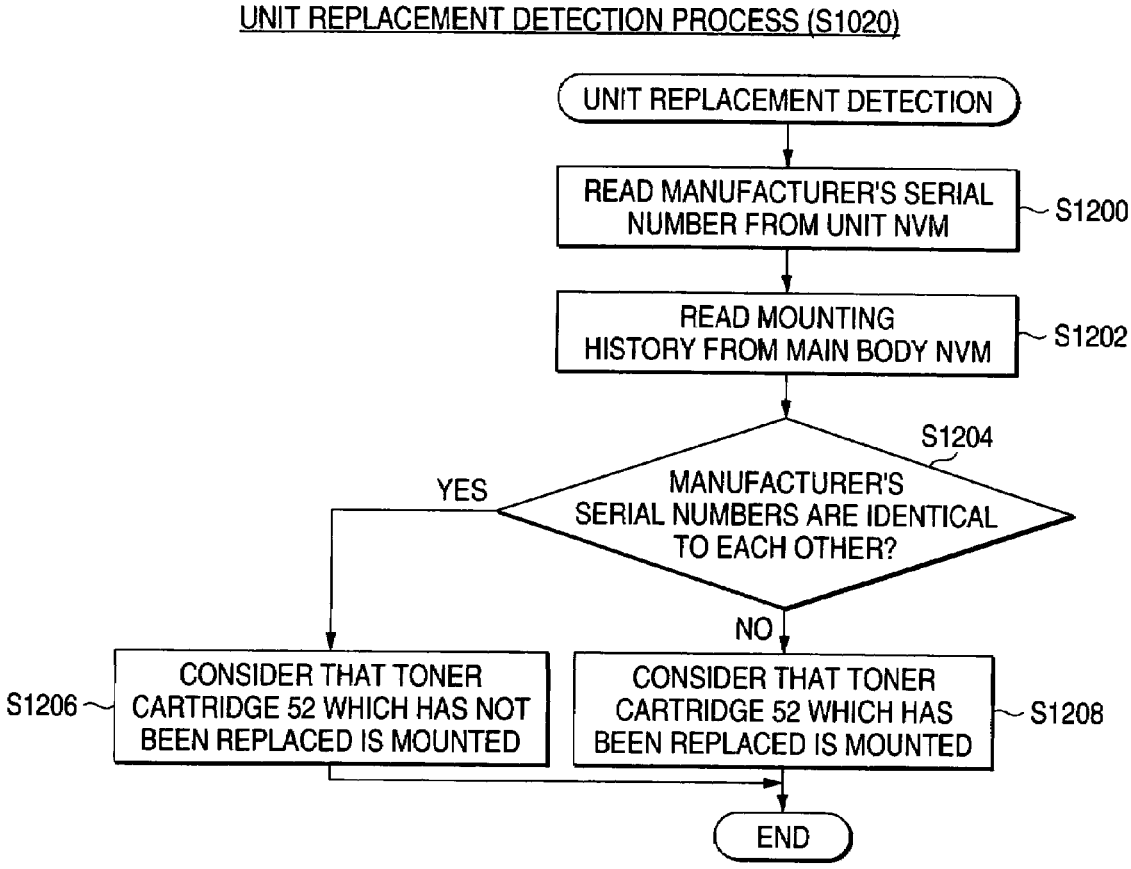
FIG. 28 is a flowchart showing a unit replacement detecting process (S1020) of detecting whether or not the toner cartridge 52 has been replaced.

FIG. 28 is a flowchart showing a unit replacement detecting process (S1020) of detecting whether or not the toner cartridge 52 has been replaced.

Figure 29:
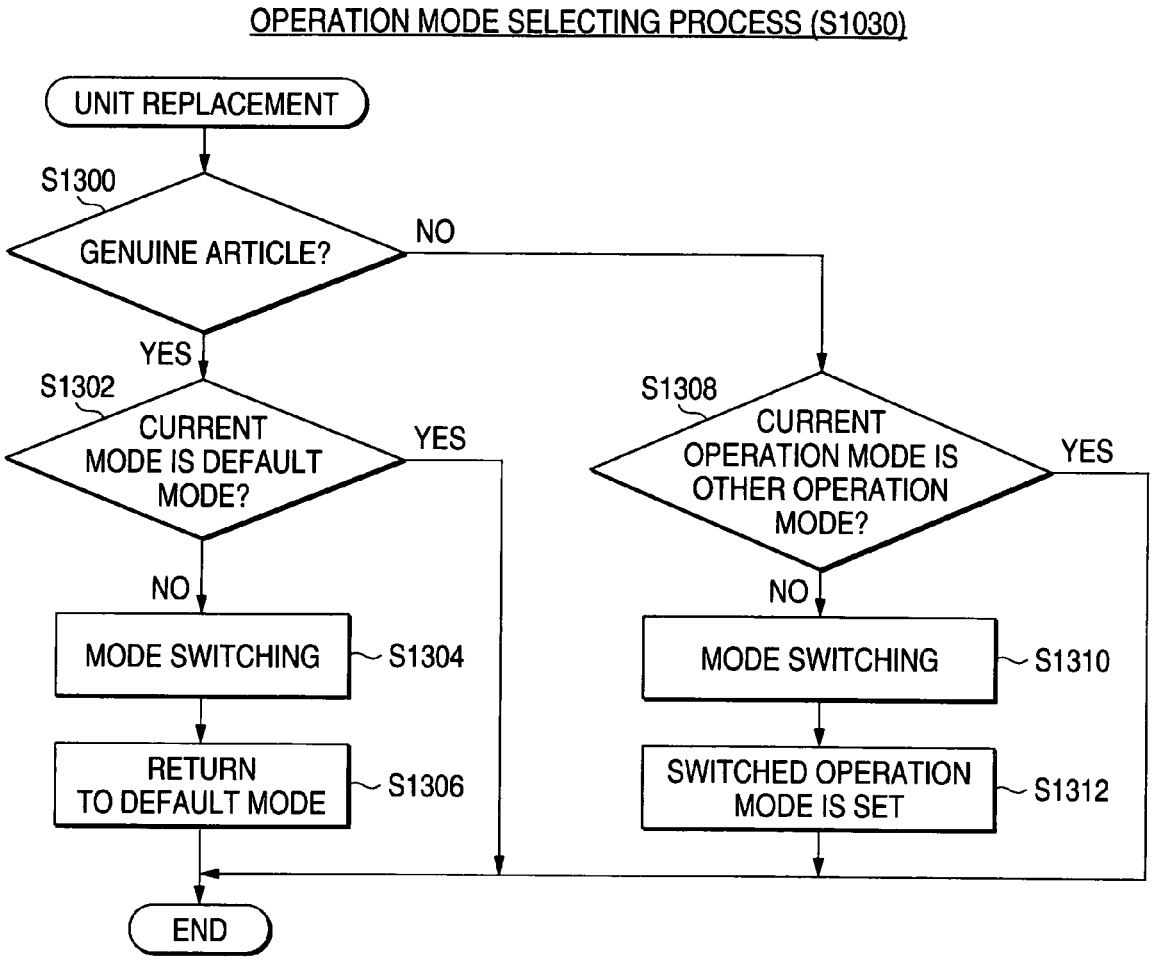
FIG. 29 is a flowchart showing a process (S1030) at the time of unit replacement.

FIG. 29 is a flowchart showing a process (S1030) at the time of unit replacement.

Figure 30:
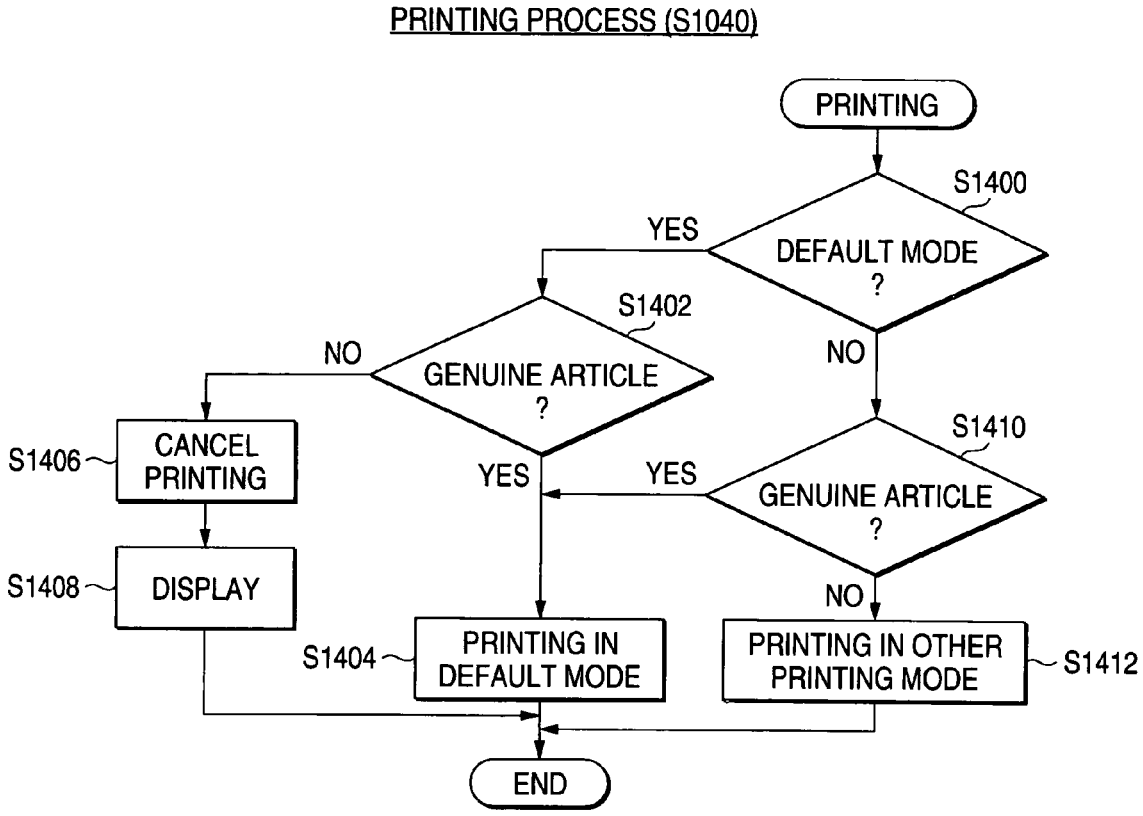
FIG. 30 is a flowchart showing a process (S1040) at the time of printing.

FIG. 30 is a flowchart showing a process (S1040) at the time of printing.

As shown in FIG. 27, in Step 1020 (S1020), whether or not a replaceable unit has been replaced is detected. In next Step S1030 (S1030), a process which selects an operation mode is carried out. Next, in Step 1040 (S1040), a printing process is executed, and the process in S1010 is then completed.

As shown in FIG. 28, first, the unit replacement detection is carried out by reading a manufacturer's serial number 280 from the unit NVM 184 in Step 1200 (S1200). In next Step 1202 (S1202), a manufacturer's serial number of a last-mounted toner, which is included in the individual unit mounting histories 262 of the main body NVM 228 is read. In next Step 1204 (S1204), whether or not the manufacturer's serial number of the last-mounted cartridge is identical to the manufacturer's serial number 280 read from the unit NVM 184 is determined. If the manufacturer's serial number of the last-mounted toner cartridge is identical to the manufacturer's serial number 280 read from the unit NVM 184, a process in S1206 is carried out. If not, a process in S1208 is carried out. In Step 1206 (S1206), it is considered that the toner cartridge 52 which has not been replaced is again mounted (that the toner cartridge is not replaced). In Step 1208 (S1208), it is considered that a toner cartridge 52 which has been replaced is mounted (that the replacement is detected).

As shown in FIG. 29, at the time of unit replacement, first, in Step 1300 (S1300), whether or not a replaceable unit is genuine is determined. Whether or not a replaceable unit is genuine is determined on the basis of, for example, one or a plurality of the following (1) to (5) information items.

(1) Information Input by User

If whether or not a replaceable unit is genuine can be input through the above-mentioned host apparatus 2 and the UI device 18 of the image forming apparatus 10, whether or not a replaceable unit is genuine is discriminated on the basis of the input information.

(2) Presence/Absence of Memory Chip

A genuine article has the memory chip 170, but any one other than a genuine article may not be mounted with the memory chip 170. Thus, if there is no response from a replaceable unit when the wireless communication unit 56 issues a request response signal, it is discriminated that the replaceable unit is not genuine.

(3) Code Information

By comparing a model code 276, a country code 278 and the like from the unit NVM 184 with the corresponding model codes 258, the corresponding country codes 260 and the like from the main body NVM 228, whether or not there is any identity therebetween is discriminated. For the purpose of such discrimination, an allowable range may can be given not only when the respective parameters are completely identical to each other but also when they exist within a range of having identity (for example, when the model codes are similar to each other, when the country codes are similar to each other, etc.)

(4) Consumption

If a life COUNT VALUE of the memory chip 170 exceeds, for example, a lifetime threshold value 240 of the program ROM 224, it can be discriminated that a replaceable unit is not genuine.

(5) Detection of Control State

As previously described, a genuine article and any one other than a genuine article may be different in charging characteristics of a developer depending on its consumption. Thus, even if a predetermined correction is made, if the toner density does not arrive at a predetermined value, it can be discriminated that a replaceable unit is not genuine.

Figure 31:
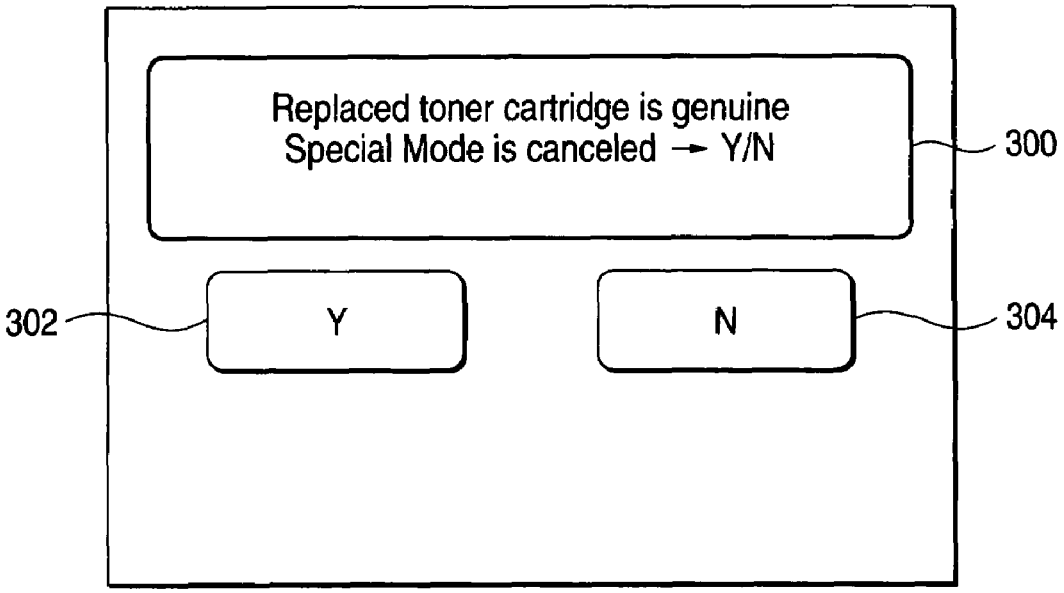
FIG. 31 shows a display aspect displayed on an UI device when a toner cartridge has been replaced with a genuine article.

In Step 1300 (S1300), if it is determined that a replaceable unit is genuine, a process in Step 1302 (S1302) is carried out to determine whether or not a current operation mode is a default mode. The determination of the current operation mode is made from an operation mode finally stored in the above-mentioned individual operation mode histories 270. In Step 1302 (S1302), if it is determined that the current operation mode is a default mode, the operation mode selecting process is completed to continue to operate in the default mode as it is. On the other hand, in Step 1302 (S1302), if it is determined that the current operation mode is not a default mode, a mode switching process is executed in next Step 1304 (S1304). For example, as shown in FIG. 31, the mode switching process in Step 1304 (S1304) is carried out by displaying on a display unit 300 a notice of an event that a replaceable unit has been replaced with a genuine article, to the UI device 18 of the image forming apparatus 10 or the host apparatus 2, and selectively pushing any one of change-over switches 302 and 304. It is noted herein that the switching of an operation mode may be performed automatically rather than by a user's operation. In next Step 1306 (S1306), the operation mode returns to a default mode, and the operation mode selecting process is then completed.

Figure 32:
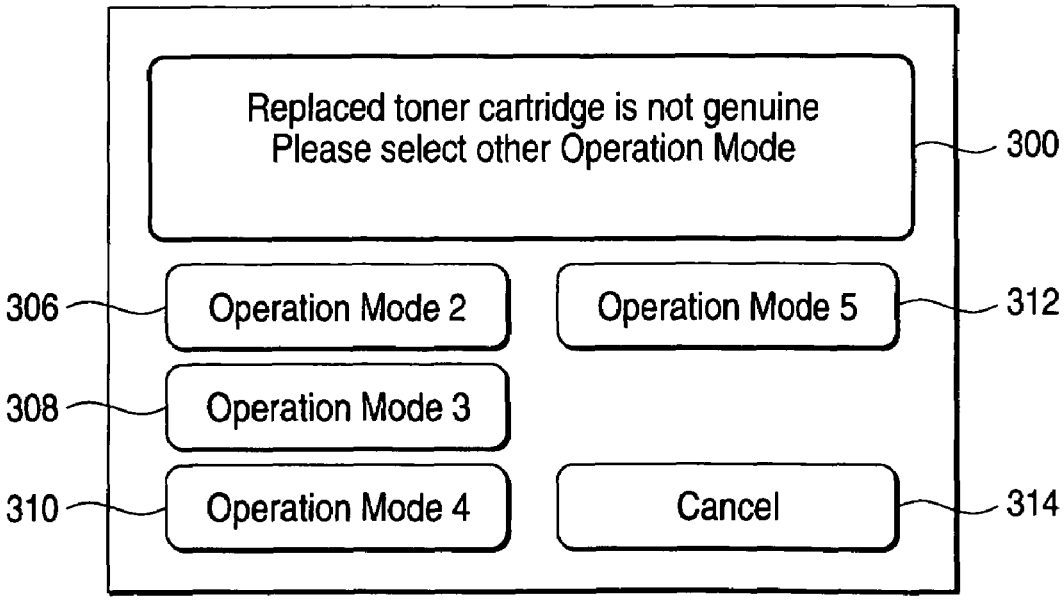
FIG. 32 shows a display aspect displayed on an UI device when a toner cartridge has been replaced with any one other than a genuine article.

In Step 1300 (S1300), if it is determined that a replaceable unit is not genuine, a process in Step 1308 (S1308) is carried out to determine whether or not a current operation mode is other operation mode. The determination of the current operation mode is made from an operation mode finally stored in the above-mentioned individual operation mode histories 270. In Step 1308 (S1308), if it is determined that the current operation mode is other operation mode, the operation mode selecting process is completed to continue to operate in the other operation mode as it is. On the other hand, in Step 1308 (S1308), if it is determined that the current operation mode is not a default mode, a mode switching process is executed in next Step 1310 (S1310). For example, as shown in FIG. 32, the mode switching process in Step 1310 (S1310) is carried out by displaying on a display unit 300 a notice of an event that a replaceable unit has been replaced with any one other than a genuine article, to the UI device 18 of the image forming apparatus 10 or the host apparatus 2, and selectively pushing any one of change-over switches 306, 308, 310 and 312. It is noted herein that the switching of an operation mode may be performed automatically rather than by a user's operation. When a canceling switch 314 is selected, the current operation mode continues as it is.

In next Step 1306 (S1306), an operation mode selected in Step 1310 (S1310) is set, and the operation mode selecting process is then completed.

As shown in FIG. 30, printing control starts by a printing command from a start button provided in the UI device 18 of the image forming apparatus 10, or the host apparatus 2. First, in Step 1400 (S1400), it is determined whether or not a current operation mode is a default mode. In Step 1400 (S1400), if it is determined that the current mode is set to the default mode, in Step 1402 (S1402), whether or not a replaceable unit is genuine is determined. In Step 1402 (S1402), if it is determined that a replaceable unit is genuine, a process in Step 1404 (S1404) is carried out to execute printing in the default mode. On the other hand, in Step 1402 (S1402), if it is determined that a replaceable unit is not genuine, a process in Step 1406 (S1406) is carried out to cancel a printing start command. Then, in Step 1408 (S1408), display is performed, and the printing process is then completed. In this case, since any one other than a genuine article is mounted as the replaceable unit irrespective of being set to a default mode, the operation of the image forming apparatus 10 cannot be guaranteed, thereby stopping the image forming operation. The display in Step 1408 (S1408) urges a user to switch a current operation mode to other operation mode, for example, as shown in FIG. 32. If a current operation mode has been switched to other operation mode, printing can be performed in the other operation mode.

In Step 1400 (S1400), if it is determined that the current operation mode is not set to the default mode, a process in Step 1410 (S1410) is carried out to determine whether or not a replaceable unit is genuine. In Step 1410 (S1410), if it is determined that a replaceable unit is genuine, a process in Step 1404 (S1404) is carried out to execute printing in a default mode, though the current operation mode is set to any one other than the default mode. As described above, whether or not the current operation mode is set to a default mode can be automatically determined, but display shown in FIG. 31 may be performed so that a user can select an operation mode. In Step 1410 (S1410), if it is determined that a replaceable unit is genuine, a process in Step 1412 (S1412) is carried out to execute printing in other operation mode.

Meanwhile, although the above embodiment has been described about the case in which the replaceable unit is a toner cartridge, the present invention is not limited thereto, and is also applicable to other replaceable units.

What is claimed is:

1. An image forming apparatus comprising:

an image forming apparatus main body;

at least one replaceable unit replaceably mounted to the image forming apparatus main body;

an input unit for selecting any one of an operation mode corresponding to the replaceable unit which is a genuine article and operation modes different from the operation mode;

a control unit for performing controls according to an operation mode selected by the input unit; and a reservation receiving unit for, when an operation mode with respect to a replaceable unit to be mounted next to the replaceable unit is selected by the input unit before the replacement of the replaceable unit which is being mounted, receiving the selected operation mode as a reservation, wherein, when the reservation of an operation mode is received by the reservation receiving unit, the control unit applies the operation mode according to the received reservation.

2. The image forming apparatus according to claim 1, further comprising:

a lifetime detecting unit for detecting a lapse of a usable time of the replaceable unit which is being mounted, wherein, when the lapse of the usable time of the replaceable unit is detected by the lifetime detecting unit, the control unit starts controls according to the reserved operation mode.

3. The image forming apparatus according to claim 1, further comprising:

a replacement detecting unit for detecting a replacement of the replaceable unit, wherein, when the replacement of the replaceable unit is detected by the replacement detecting unit, the control unit starts controls according to the reserved operation mode.

4. The image forming apparatus according to claim 1, further comprising:

a message output unit for outputting a reservation start message which urges the reservation of the operation mode, at a timing according to a consumption of the replaceable unit, wherein, between the timing at which the reservation start message is output and a timing at which the replaceable unit is replaced, when an operation mode is selected by the input unit, the reservation receiving unit receives the selected operation mode as the reservation.

5. The image forming apparatus according to claim 1, further comprising:

a discriminating unit that discriminates whether or not the replaceable unit, which is being mounted is the genuine article, wherein the control unit decides an operation mode to be applied according to a combination of a discrimination result of the discriminating unit and the reserved operation mode by the reservation receiving unit.

6. The image forming apparatus according to claim 5, wherein, when the operation mode corresponding to the discrimination result of the discriminating unit and the reserved operation mode by the reservation receiving unit discord with each other, the control unit starts controls according to the operation mode corresponding to the discrimination result or the reserved operation mode.

7. An image forming apparatus comprising:

an image forming apparatus main body;

at least one replaceable unit replaceably mounted to the image forming apparatus main body;

a message output unit for outputting a reservation start message which urges a reservation of an operation mode, at a timing according to a consumption of the replaceable unit;

a reservation receiving unit for receiving the reservation of the operation mode; and a control unit for performing controls according to the reservation of the operation mode received by the reservation receiving unit.

8. An image forming system comprising:

an image forming apparatus; and a host apparatus connected to the image forming apparatus, the host apparatus comprising:

an input unit for selecting any one of an operation mode corresponding to a replaceable unit which is a genuine article and other operation modes different from the operation mode, the image forming apparatus comprising:

an image forming apparatus main body;

at least one replaceable unit replaceably mounted to the image forming apparatus main body;

a control unit for performing controls according to an operation mode selected by the input unit; and a reservation receiving unit for, when an operation mode with respect to a replaceable unit to be mounted next to the replaceable unit which is being mounted is selected by the input unit before the replacement of the replaceable unit which is being mounted, receiving the selected operation mode as a reservation, wherein, when the reservation of an operation mode with respect to any one replaceable unit is received by the reservation receiving unit, the control unit performs controls according to the reserved operation mode at the time that the any one replaceable unit is mounted.

9. A method of controlling an image forming apparatus in which at least one replaceable unit is replaceably mounted to an image forming apparatus main body, the method comprising:

receiving a reservation of an operation mode with respect to a replaceable unit to be mounted next to the replaceable unit which is being mounted before the replacement of the replaceable unit which is being mounted; and starting controls according to the reserved operation mode on an assumption that the replaceable unit which was being mounted has been replaced.

10. An image forming apparatus comprising:

an image forming apparatus main body, at least one replaceable unit replaceably mounted in the image forming apparatus main body, a discriminating unit that discriminates whether or not the replaceable unit is genuine, a switching unit that switches a first operation mode corresponding to the replaceable unit which is genuine to a second operation mode corresponding to the replaceable unit which is not genuine, and a control unit that performs control in an operation mode switched by the switching unit.

11. The image forming apparatus according to claim 10, further comprising a displaying unit that displays the switching unit.

12. The image forming apparatus according to claim 10, wherein operation items inappropriate for the first operation mode when the replaceable unit which is not genuine has been mounted are excluded from the second operation mode.

13. The image forming apparatus according to claim 10, further comprising an indicating unit that indicates an image forming operation, wherein the control unit cancels the indication of the indicating unit, if the first operation mode is set, and the discriminating unit discriminates that the replaceable unit is not genuine.

14. The image forming apparatus according to claim 10, wherein the switching unit switches an operation mode according to discrimination results of the discriminating unit.

15. An image forming apparatus comprising:

an image forming apparatus main body, at least one replaceable unit replaceably mounted in the image forming apparatus main body, a detecting unit that detects that the replaceable unit has been replaced, a discriminating unit that discriminates, if the detecting unit detects that the replaceable unit has been replaced, whether or not the replaced replaceable unit is genuine, a switching unit that switches a first operation mode corresponding to the replaceable unit which is genuine to a second operation mode corresponding to the replaceable unit which is not genuine, and a control unit that performs control in an operation mode switched by the switching unit.

16. An image forming apparatus comprising:

an image forming apparatus main body, at least one replaceable unit replaceably mounted in the image forming apparatus main body, a discriminating unit that discriminates whether or not the replaceable unit is genuine, a switching unit that switches a second operation mode corresponding to the replaceable unit which is not genuine to a first operation mode corresponding to the replaceable unit which is genuine, and a control unit that performs control in an operation mode switched by the switching unit.

17. An image forming apparatus comprising:

an image forming apparatus main body, at least one replaceable unit replaceably mounted in the image forming apparatus main body, a detecting unit that detects that the replaceable unit has been replaced, a discriminating unit that discriminates, if the detecting unit detects that the replaceable unit has been replaced, whether or not the replaced replaceable unit is genuine, a switching unit that switches a first operation mode corresponding to the replaceable unit which is genuine to a second operation mode corresponding to the replaceable unit which is not genuine, and a control unit that performs control in an operation mode switched by the switching unit.

18. An image forming system comprising:

an image forming apparatus including an image forming apparatus main body; at least one replaceable unit replaceably mounted in the image forming apparatus main body; a discriminating unit that discriminates whether or not the replaceable unit is genuine; and a control unit that performs control in a predetermined operation mode, and a host apparatus connected to the image forming apparatus, wherein the host apparatus includes a switching unit that switches a first operation mode corresponding to the replaceable unit which is genuine to a second operation mode corresponding to the replaceable unit which is not genuine.

19. An image forming system comprising:

an image forming apparatus including: an image forming apparatus main body; at least one replaceable unit replaceably mounted in the image forming apparatus main body; a detecting unit that detects that the replaceable unit has been replaced; a discriminating unit that discriminates, if the detecting unit detects that the replaceable unit has been replaced, whether or not the replaced replaceable unit is genuine; and a control unit that performs control in a predetermined operation mode, and a host apparatus connected to the image forming apparatus, wherein the host apparatus includes a switching unit that switches a first operation mode corresponding to the replaceable unit which is genuine to a second operation mode corresponding to the replaceable unit which is not genuine.

20. An image forming system comprising:

an image forming apparatus including: an image forming apparatus main body; at least one replaceable unit replaceably mounted in the image forming apparatus main body; a discriminating unit that discriminates whether or not the replaceable unit is genuine; and a control unit that performs control in a predetermined operation mode, and a host apparatus connected to the image forming apparatus, wherein the host apparatus includes a switching unit that switches a second operation mode corresponding to the replaceable unit which is not genuine to a first operation mode corresponding to the replaceable unit which is genuine.

21. An image forming system comprising:

an image forming apparatus including: an image forming apparatus main body; at least one replaceable unit replaceably mounted in the image forming apparatus main body; a detecting unit that detects that the replaceable unit has been replaced, a discriminating unit that discriminates, if the detecting unit detects that the replaceable unit has been replaced, whether or not the replaced replaceable unit is genuine; a control unit that performs control in a predetermined operation mode, and a host apparatus connected to the image forming apparatus, wherein the host apparatus includes a switching unit that switches a second operation mode corresponding to the replaceable unit which is not genuine to a first operation mode corresponding to the replaceable unit which is genuine.

* * * * *